US009726330B2

(12) United States Patent
Wilcox et al.

(10) Patent No.: US 9,726,330 B2
(45) Date of Patent: Aug. 8, 2017

(54) LED LAMP

(71) Applicant: Cree, Inc., Durham, NC (US)

(72) Inventors: Kurt Wilcox, Libertyville, IL (US); Andrew Bendtsen, Racine, WI (US); Mark Dixon, Morrisville, NC (US)

(73) Assignee: Cree, Inc., Durham, NC (US)

( * ) Notice: Subject to any disclaimer, the term of this patent is extended or adjusted under 35 U.S.C. 154(b) by 609 days.

(21) Appl. No.: 14/224,501

(22) Filed: Mar. 25, 2014

(65) Prior Publication Data

US 2015/0176770 A1 Jun. 25, 2015

Related U.S. Application Data

(60) Provisional application No. 61/919,192, filed on Dec. 20, 2013.

(51) Int. Cl.

| | |
|---|---|
| ***H01R 13/71*** | (2006.01) |
| ***H01R 33/96*** | (2006.01) |
| ***F21K 99/00*** | (2016.01) |
| ***F21V 19/00*** | (2006.01) |
| ***F21K 9/90*** | (2016.01) |
| ***F21V 23/06*** | (2006.01) |
| ***F21K 9/27*** | (2016.01) |
| ***F21K 9/60*** | (2016.01) |
| *F21V 19/02* | (2006.01) |
| *F21K 9/65* | (2016.01) |
| *F21Y 103/10* | (2016.01) |
| *F21Y 115/10* | (2016.01) |

(52) U.S. Cl.

CPC ..... *F21K 9/175* (2013.01); *F21K 9/27* (2016.08); *F21K 9/60* (2016.08); *F21K 9/90* (2013.01); *F21V 19/008* (2013.01); *F21V 23/06* (2013.01); *H01R 13/71* (2013.01); *H01R 33/96* (2013.01); *F21K 9/65* (2016.08); *F21V 19/004* (2013.01); *F21V 19/02* (2013.01); *F21Y 2103/10* (2016.08);

(Continued)

(58) Field of Classification Search

CPC .... H05K 1/189; F21K 9/20; F21S 4/20; F21S 4/22; F21V 19/003; F21V 19/008; F21V 19/045; F21V 29/80; F21V 3/0445; F21V 3/049; F21V 5/002; F21V 7/005; F21Y 2103/10; H05B 33/0803

See application file for complete search history.

(56) References Cited

U.S. PATENT DOCUMENTS

| | | | |
|---|---|---|---|
| 799,770 | A | 9/1905 | Wultze |
| 5,463,280 | A | 10/1995 | Johnson |

(Continued)

FOREIGN PATENT DOCUMENTS

| | | | | |
|---|---|---|---|---|
| CN | 201246712 | Y | * | 5/2009 |
| CN | 201377711 | Y | | 1/2010 |

(Continued)

OTHER PUBLICATIONS

U.S. Appl. No. 29/467,949, filed Sep. 25, 2013.

(Continued)

*Primary Examiner* — Hargobind S Sawhney

(74) *Attorney, Agent, or Firm* — Dennis J. Williamson; Moore & Van Allen PLLC

(57) ABSTRACT

A tube that is at least partially optically transmissive. An LED mounted on a substrate is positioned in the tube and is operable to emit light through the tube when energized through an electrical path. Pins are in the electrical path. An electrical conductor electrically couples the pins to the electrical path, the electrical conductor is biased into engagement with an electrical contact on the substrate. The substrate may be secured to the tube by an adhesive. The substrate may be secured to the end caps and be suspended in the tube.

39 Claims, 25 Drawing Sheets

(52) U.S. Cl.
CPC ..... *F21Y 2115/10* (2016.08); *Y10T 29/49117* (2015.01)

(56) References Cited

U.S. PATENT DOCUMENTS 5,585,783 A 12/1996 Hall
5,655,830 A 8/1997 Ruskouski
5,688,042 A 11/1997 Madadi et al.
5,947,588 A 9/1999 Huang
5,949,347 A 9/1999 Wu
5,952,916 A 9/1999 Yamabe
6,220,722 B1 4/2001 Begemann
6,276,822 B1 8/2001 Bedrosian et al.
6,305,109 B1 10/2001 Lee
6,452,217 B1 9/2002 Wojnarowski et al.
6,465,961 B1 10/2002 Cao
6,634,770 B2 10/2003 Cao
6,635,987 B1 10/2003 Wojnarowski et al.
6,639,360 B2 10/2003 Roberts et al.
6,746,885 B2 6/2004 Cao
6,846,094 B2 * 1/2005 Luk ..... H05B 33/0857 362/240
6,853,151 B2 2/2005 Leong et al.
6,860,628 B2 3/2005 Robertson et al.
6,936,968 B2 8/2005 Cross et al.
7,048,410 B2 5/2006 Kutler
7,049,761 B2 5/2006 Timmermans et al.
7,114,830 B2 10/2006 Robertson et al.
7,307,391 B2 12/2007 Shan
7,510,299 B2 3/2009 Timmermans et al.
7,815,338 B2 10/2010 Siemiet et al.
7,926,975 B2 4/2011 Siemiet et al.
7,976,196 B2 7/2011 Ivey et al.
8,058,659 B2 11/2011 Bisberg
8,093,823 B1 1/2012 Ivey et al.
8,115,411 B2 2/2012 Shan
8,118,447 B2 2/2012 Simon et al.
8,214,084 B2 7/2012 Ivey et al.
8,247,985 B2 8/2012 Timmermans et al.
8,282,247 B2 10/2012 Ivey et al.
8,324,817 B2 12/2012 Ivey et al.
8,330,362 B2 12/2012 Lin
8,360,599 B2 1/2013 Ivey et al.
8,362,710 B2 1/2013 Langovsky
8,382,327 B2 2/2013 Timmermans et al.
8,419,223 B2 4/2013 Withers
8,421,366 B2 4/2013 Palazzolo et al.
8,449,137 B2 5/2013 Dassanayake et al.
8,482,212 B1 7/2013 Ivey et al.
8,573,813 B2 11/2013 Ivey et al.
8,596,813 B2 12/2013 Ivey
9,099,575 B2 8/2015 Medendorp, Jr. et al.
9,169,977 B2 10/2015 Medendorp, Jr. et al.
9,222,659 B2 12/2015 Medendorp, Jr. et al.
9,328,874 B2 5/2016 Demuynck et al.
9,388,948 B2 7/2016 Demuynck et al.
2002/0060526 A1 5/2002 Timmermans et al.
2004/0201990 A1 10/2004 Meyer
2005/0007033 A1 1/2005 Kan et al.
2006/0126325 A1 6/2006 Lefebvre et al.
2009/0140271 A1 6/2009 Sah
2009/0184618 A1 7/2009 Hakata et al.
2010/0033964 A1 * 2/2010 Choi ..... F21K 9/00 362/234
2010/0067230 A1 3/2010 Uang et al.
2010/0079075 A1 * 4/2010 Son ..... F21V 3/02 315/152
2010/0103664 A1 4/2010 Simon et al.
2010/0124054 A1 5/2010 Chen et al.
2010/0201239 A1 8/2010 Mostoller et al.
2011/0051413 A1 3/2011 Hand
2011/0085335 A1 * 4/2011 Osawa ..... F21K 9/175 362/249.14
2011/0103053 A1 5/2011 Chen et al.
2011/0169408 A1 * 7/2011 Chen ..... F21K 9/00 315/51
2011/0175536 A1 * 7/2011 Fujita ..... F21S 8/02 315/185 R
2011/0176297 A1 * 7/2011 Hsia ..... F21V 25/04 362/217.1
2011/0194278 A1 8/2011 Yang et al.
2011/0235320 A1 9/2011 Cai et al.
2012/0008314 A1 * 1/2012 Simon ..... F21K 9/90 362/217.1
2012/0040585 A1 2/2012 Huang
2012/0043884 A1 2/2012 Lee et al.
2012/0051038 A1 3/2012 Yue et al.
2012/0051041 A1 3/2012 Edmond et al.
2012/0099322 A1 4/2012 Simon et al.
2012/0169234 A1 7/2012 Shew
2012/0243127 A1 9/2012 Iwasaki et al.
2012/0243216 A1 * 9/2012 Lai ..... F21V 5/002 362/218
2012/0300409 A1 11/2012 Lee
2013/0271971 A1 10/2013 Uemura et al.
2013/0301255 A1 11/2013 Kim et al.
2013/0343046 A1 * 12/2013 Tsai ..... F21K 9/00 362/217.05
2014/0003054 A1 * 1/2014 Simon ..... F21V 25/04 362/249.05
2014/0009925 A1 * 1/2014 Verhoeven ..... F21V 19/008 362/221
2014/0029246 A1 1/2014 Umeda
2014/0029247 A1 * 1/2014 Gielen ..... F21V 19/008 362/217.13
2014/0043804 A1 2/2014 Negley et al.

FOREIGN PATENT DOCUMENTS

CN 101655189 A 2/2010
CN 102072421 A 5/2011
EP 1058221 A2 12/2000
EP 1475846 A2 11/2004
EP 2489929 A2 8/2012
EP 2525131 A1 11/2012
EP 2615357 A2 7/2013
GB 2345954 A 7/2000
JP H08162677 A 6/1996
JP P8-162677 6/1996
JP H09265807 A 10/1997
JP 2000173304 A 6/2000
JP 2001118403 A 4/2001
JP 2007059930 A 3/2007
JP 2008288183 A 11/2008
JP 2009117346 A 5/2009
JP 3153766 U 9/2009
JP 2009277586 A 11/2009
JP 3184896 U * 7/2013 ..... F21K 9/17
KR 2011131908 A 12/2011
TW M353300 U 3/2009
WO 9833007 7/1998
WO 0124583 A1 4/2001
WO 0160119 A2 8/2001
WO 0211250 A1 2/2002
WO 2004100213 A2 11/2004
WO 2009143047 A2 11/2009
WO 2010099755 A1 9/2010
WO 2011072580 A1 6/2011
WO 2012011279 A1 1/2012
WO 2012031533 A1 3/2012
WO WO 2012138554 A2 * 10/2012 ..... F21V 13/04

OTHER PUBLICATIONS

U.S. Appl. No. 13/943,152, filed Jul. 16, 2013.
Cree, Inc., International Application No. PCT/US2014/070561, Invititation to Pay Additional Fees and, Where Applicable, Protest Fee, Mar. 3, 2015.
Cree, Inc., International Application No. PCT/US2014/070561, International Search Report and Written Opinion, Jun. 22, 2015.

(56) References Cited

OTHER PUBLICATIONS

LiquiLEDs, Liquid LED, http://www.liquidleds.com.tw/, Sep. 28, 2010, 1 page.
Cree, Inc., International Application No. PCT/US2011/062795, International Search Report and Written Opinion, Jun. 1, 2012.
U.S. Appl. No. 13/943,376, filed Jul. 16, 2013.
U.S. Appl. No. 13/943,455, filed Jul. 16, 2013.
U.S. Appl. No. 14/103,063, filed Dec. 11, 2013.
U.S. Appl. No. 13/772,436, filed Feb. 21, 2013.
Cree, Inc., International Application No. PCT/US2015/021220, International Search Report and Written Opinion, May 21, 2015.

* cited by examiner

LED LAMP

This application claims benefit of priority under 35 U.S.C. §119(e) to the filing date of U.S. Provisional Application No. 61/919,192, as filed on Dec. 20, 2013, which is incorporated herein by reference in its entirety.

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

SUMMARY OF THE INVENTION

In some embodiments, a lamp comprises an enclosure comprising a tube, the tube being at least partially optically transmissive. At least one LED is in the enclosure and is operable to emit light through the tube when energized through an electrical path. The at least one LED is mounted on a substrate. A first pair of pins are rotatable relative to the enclosure and are in the electrical path. An electrical conductor electrically couples the first pair of pins to the electrical path. The electrical conductor is biased into engagement with an electrical contact on the substrate.

The enclosure may comprise a glass tube having a first diffusion layer. The first diffusion layer may comprise an etched inner surface of the tube. The glass tube may comprise a second diffusion layer. The second diffusion layer may comprise a media impregnated with a diffuser applied to an outer surface of the tube. The enclosure may comprise a plurality of LEDs where the plurality of LEDs are mounted on the substrate and extend for substantially the length of the tube. The substrate may comprise a low thermally conductive layer and a metal layer in the electrical path. The substrate may be mounted offset from a centerline of the tube. The substrate may be secured to the tube using an adhesive. The substrate may comprise a flex circuit. The flex circuit may be secured to the tube. The flex circuit may be secured to the tube using an adhesive. The flex circuit may be secured to the end caps and may be suspended in the tube. The flex circuit may comprise a plurality of subcircuits where the plurality of subcircuits are mechanically and electrically coupled to one another. The plurality of subcircuits may be identical to one another. The plurality of subcircuits may comprise a primary pad and a secondary pad connected in parallel to the primary pad. One LED may be mounted on one of the primary pad and the spare pad to vary the distance between the LED and an adjacent LED. A component may be mounted on the flex circuit between the LED and the adjacent LED. The substrate may be trapped between a support surface and the electrical conductor. The first pair of pins may be mounted on an end cap such that the first pair of pins rotate relative to the electrical conductor. The first pair of pins may be mounted in a control member where the control member rotates relative to the end cap. The control member may comprise a spacer that extends into a slot on the end cap. The substrate may be positioned between a support surface and the electrical conductor such that the spacer separates the electrical conductor from the support surface when the control member is in a first orientation relative to the end cap. The spacer may be moved to allow the electrical conductor to move into engagement with the substrate when the control member is in a second orientation relative to the end cap. A lock may prevent the control member from moving from the second position to the third position. The control member may be movable from the second position to a third position to rotate the pins relative to the at least one LED.

In one embodiment, a method of assembling a LED lamp comprises providing a tube; inserting an LED assembly into the tube, the LED assembly comprising an LED mounted on a substrate; mounting an end cap on the tube, the end cap comprising a support surface for the substrate and a conductor spaced from the supporting surface, wherein mounting the end cap on the tube comprises locating the substrate on the supporting surface between the supporting surface and the conductor; moving the conductor into engagement with an electrical contact on the substrate after the end cap is mounted on the tube.

In some embodiments a lamp comprises an enclosure comprising a tube, the tube being at least partially optically transmissive and having a first end and a second end. A LED is in the enclosure operable to emit light through the tube when energized through an electrical path. At least one pin is mounted adjacent a first end and a second end of the tube, the pins being in the electrical path. The LED is mounted on a flex circuit and the flex circuit is mounted in the tube without a heat sink.

In some embodiments a lamp comprises an enclosure comprising a tube, the tube being at least partially optically transmissive and having a first end and a second end. A LED is in the enclosure operable to emit light through the tube when energized through an electrical path. A first pin is mounted adjacent the first end of the tube and a second pin is mounted adjacent a second end of the tube, the first pin and the second pin being in the electrical path. The LED is mounted on a substrate comprising a low thermally conductive layer and a metal layer in the electrical path. The substrate is mounted in the tube without a heat sink.

The flex circuit and substrate may be suspended in the tube between the first end and the second end. A first end cap may be connected to the first end and a second end cap may be connected to the second end. The flex circuit and substrate may be suspended from the first end cap and the second end cap. The flex circuit and substrate may be suspended from the first end cap by a first electrical conductor and from the second end cap by a second electrical conductor. The first electrical conductor and the second electrical conductor may be in the electrical path. The first electrical conductor may be electrically coupled to the first pin and the second electrical conductor may be electrically coupled to the second pin. The flex circuit and substrate may be adhered to the tube. The flex circuit and substrate may be is mounted offset from a centerline of the tube. The flex circuit and substrate may comprise longitudinal edges where, the longitudinal edges contacting the interior of the tube

DETAILED DESCRIPTION

Figure 1:
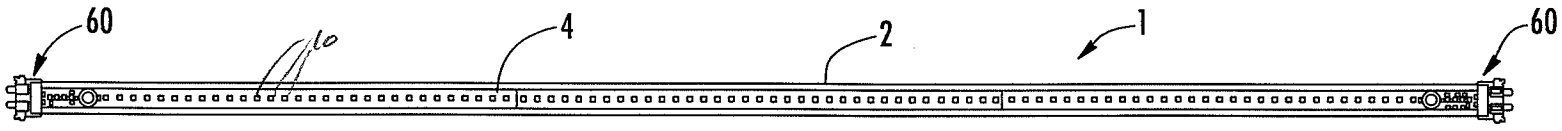
FIG. 1 is a top view showing an embodiment of a LED lamp of the invention.
Figure 2:
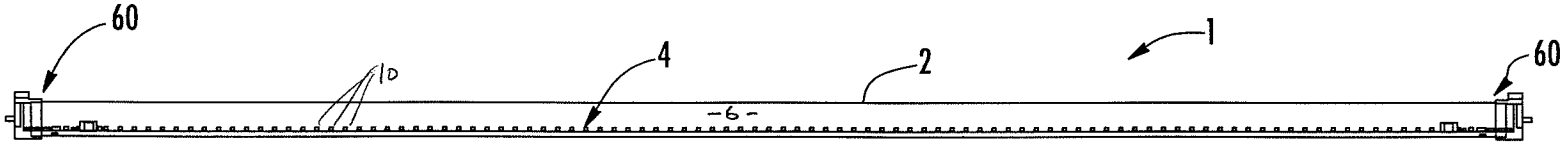
FIG. 2 is a side view of the LED lamp of FIG. 1.
Figure 3:
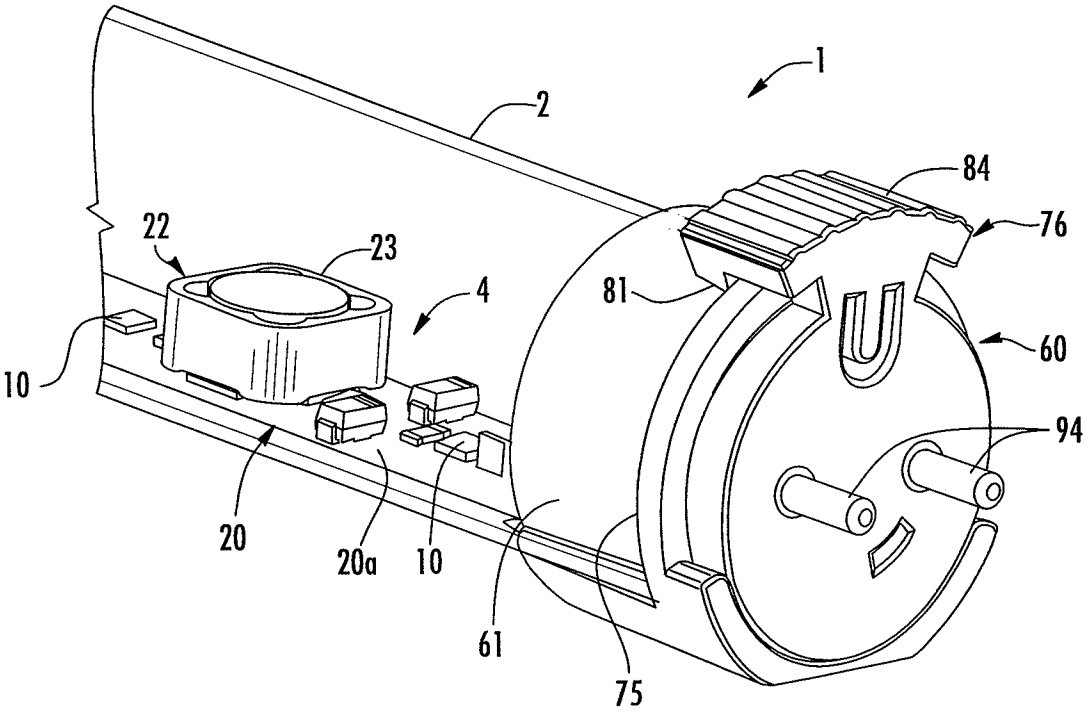
FIG. 3 is a partial perspective view of the LED lamp of FIG. 1.
Figure 4:
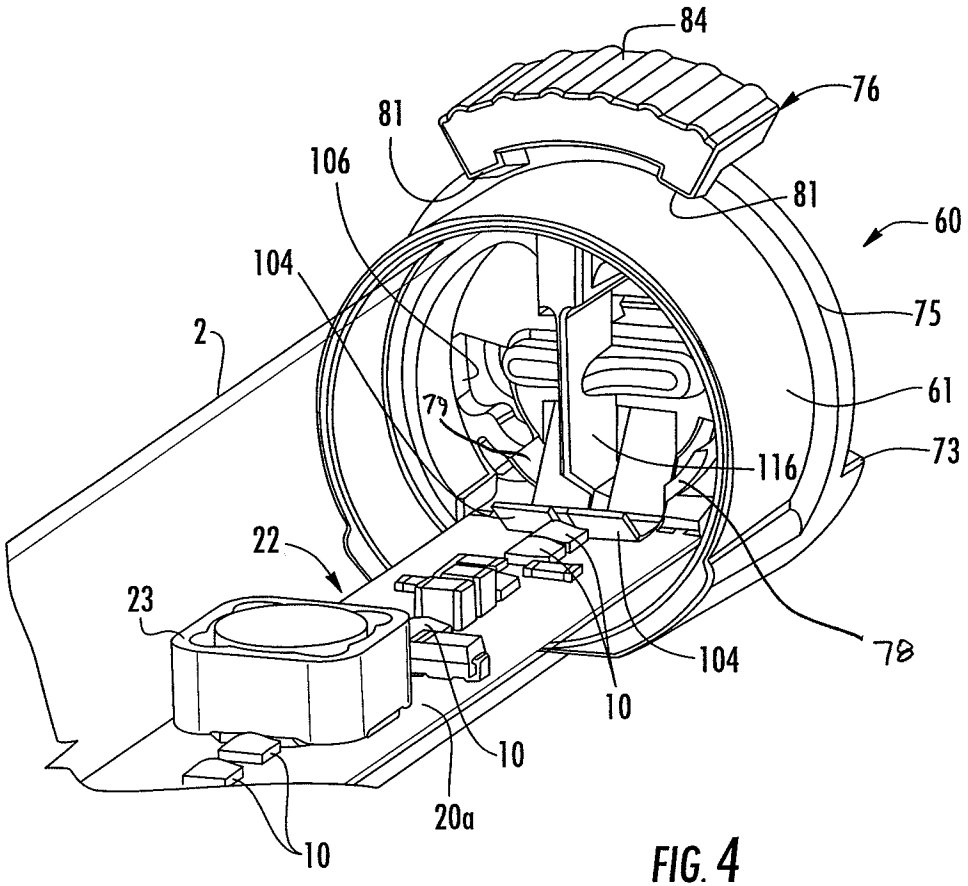
FIG. 4 is a partial perspective view of the LED lamp of FIG. 1.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Figure 26A:
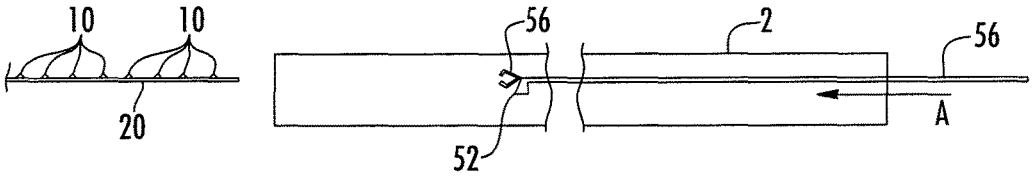
FIGS. 26A-26E disclose a method of assembling the LED assembly in the tube.
Figure 26B:
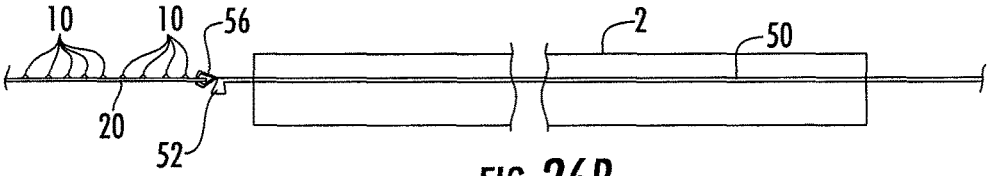
Figure 26C:
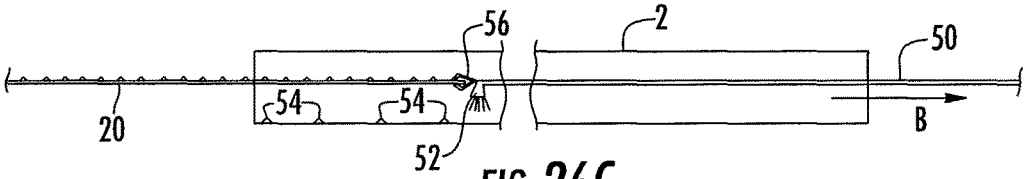
Figure 26D:
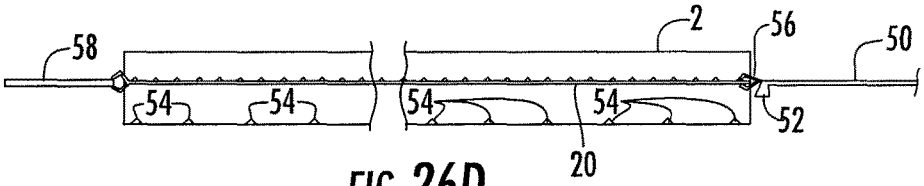
Figure 26E:
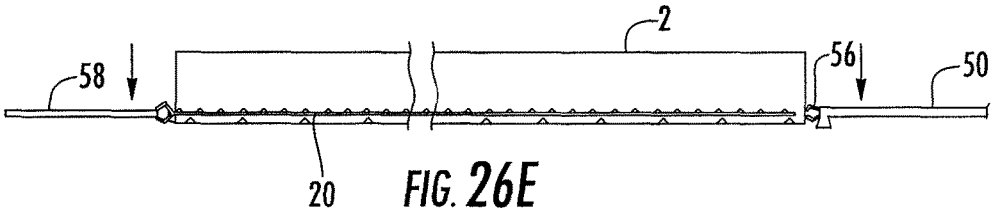
Figure 27:
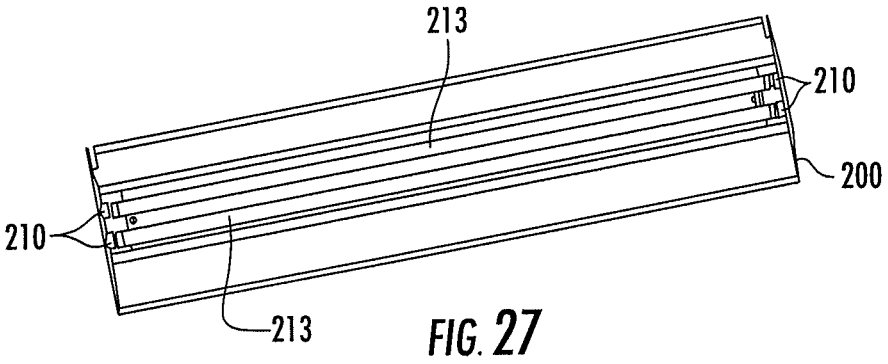
FIGS. 27 and 28 are perspective views of a fluorescent fixture.
Figure 28:
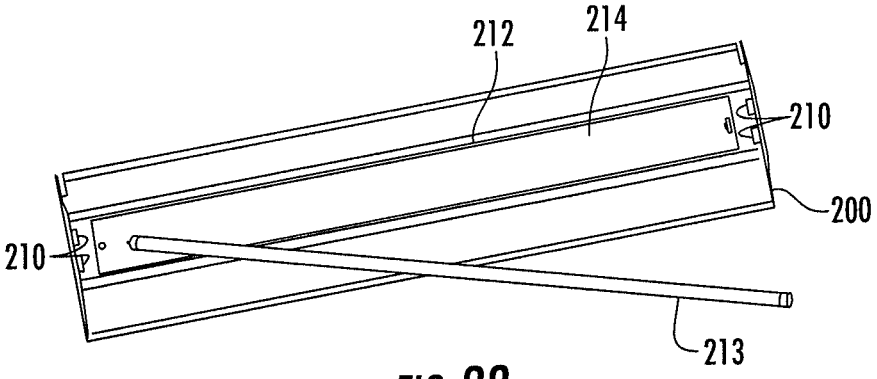

As shown in FIGS. 26 and 27, one embodiment of a traditional fluorescent troffer fixture comprises a housing 200 that may be recess mounted or flush mounted in a ceiling or other structure. In some embodiments the fluorescent fixture may have a diffuser lens. While an embodiment of a fixture is shown, the housing in which the lamp of the invention may be used may comprise a variety of shapes, sizes and configurations. The lamp of the invention may be used in any lighting fixture that uses conventional tombstone connectors. The housing typically supports a ballast and electrical conductors such as wiring that comprise the electrical connection between the lamp's tombstone connectors 210 and a power supply. The power supply may be the electrical grid of a building or other structure or the like. The tombstone connectors 210 connect to two pins formed on each end of a fluorescent tube 213 to provide power to the fluorescent tube. Typically, the ballast, wiring and other electrical components are retained in a compartment or wire way 212 in the housing. The wire way 212 typically comprises a recessed area or trough in the base of the housing. The wire way 212 may be covered by a removable wire way cover 214 such that the only exposed electrical components are the UL approved tombstone connectors 210.

Because LED based solid state lamps use less energy, are more durable, operate longer, can be combined in multicolor arrays that can be controlled to deliver virtually any color light, and generally contain no lead or mercury the conversion to, or replacement of fluorescent lighting systems with, LED lighting systems is desired. In some existing replacement lamps the entire fluorescent fixture including the troffer must be replaced. The conversion from a fluorescent light to a solid state LED based light may be time consuming and expensive. In the system of the invention, a traditional fluorescent light may be converted to an LED based solid state lamp quickly and easily by replacing the fluorescent bulb with an LED lamp. The LED lamp fits into the same housing as the fluorescent tube and uses the existing tombstone connectors to provide current to the LED lamp. The LED lamp of the invention allows a traditional fluorescent light to be converted to a solid state LED lamp without requiring specialized tools, equipment or training.

Figure 5:
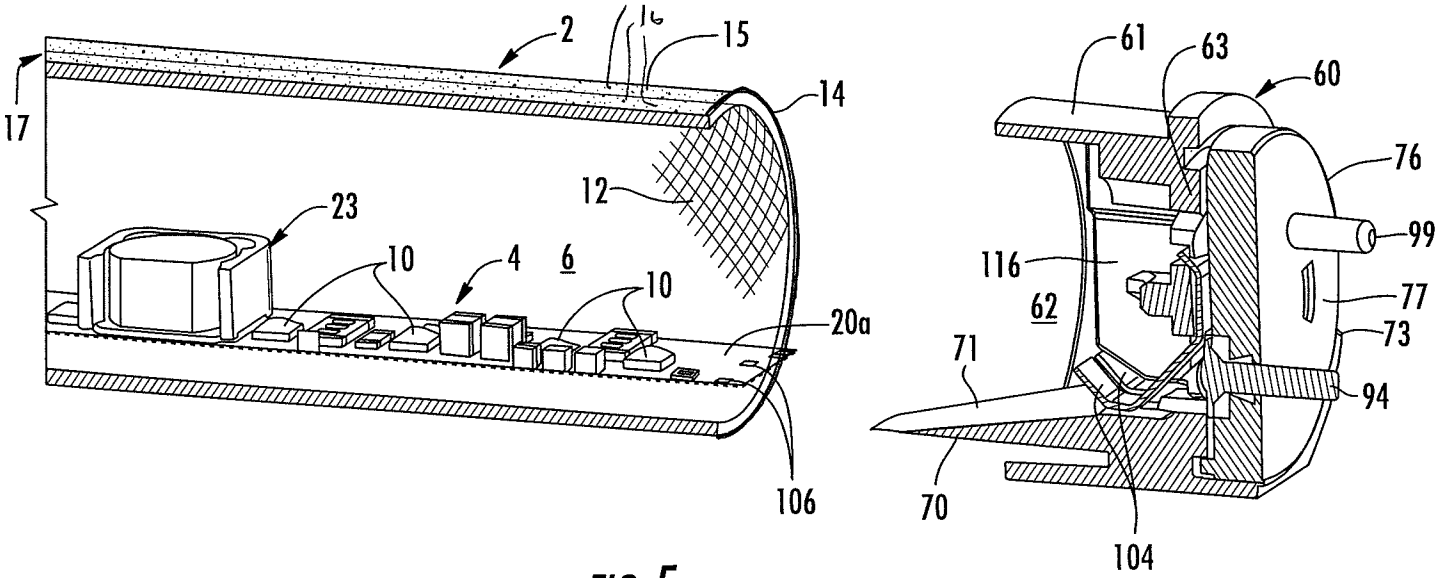
FIG. 5 is a partial perspective exploded section view of the LED lamp of FIG. 1.
Figure 6:
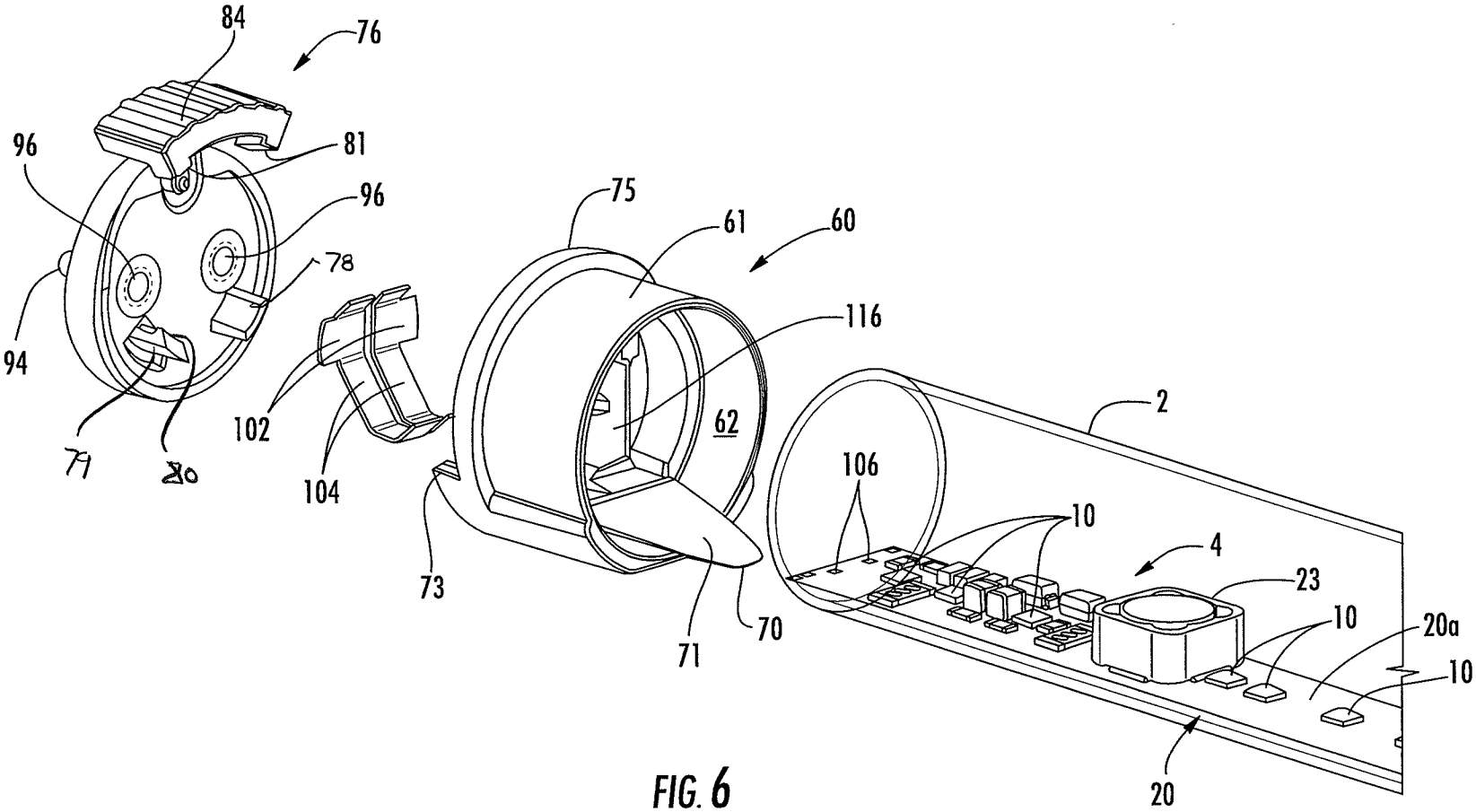
FIG. 6 is a partial perspective exploded view of the LED lamp of FIG. 1.
Figure 7:
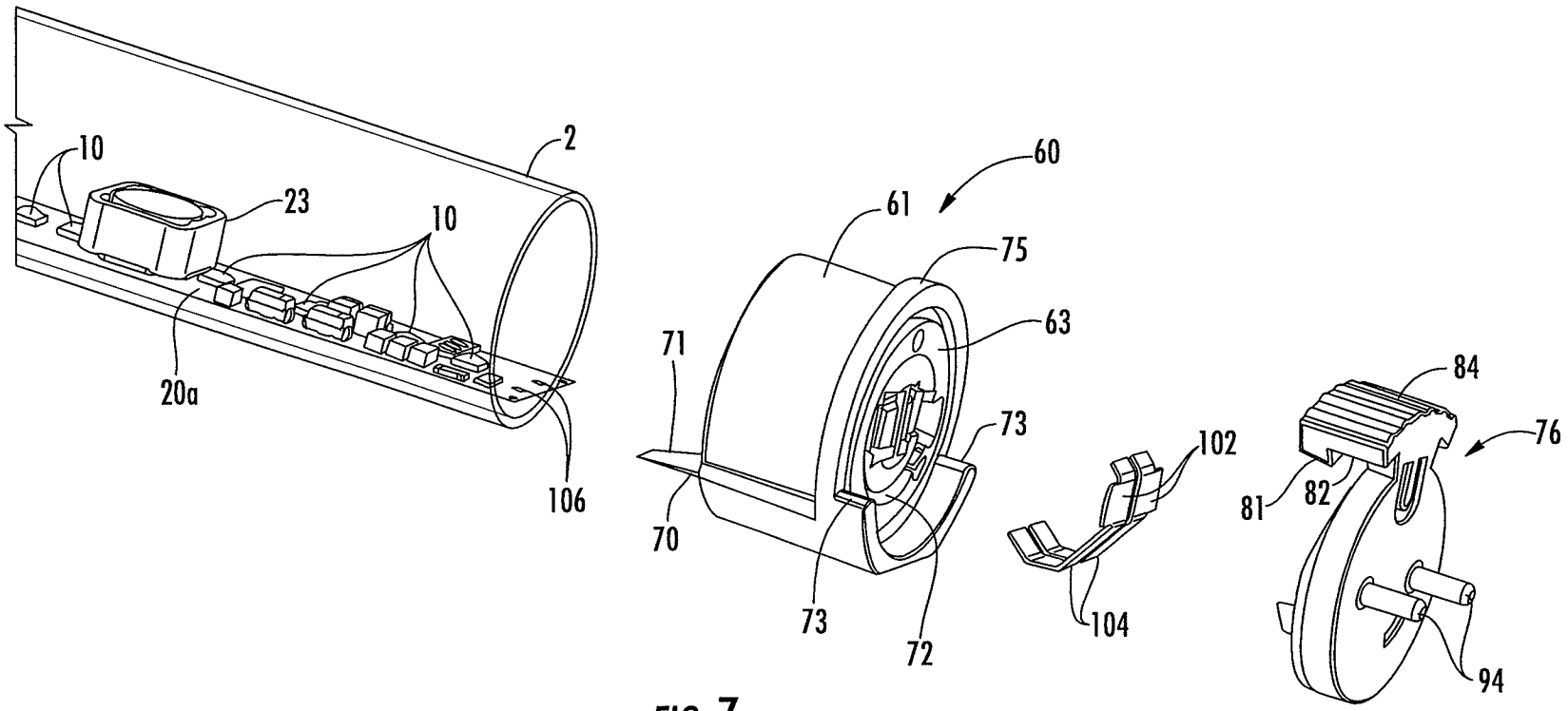
FIG. 7 is a partial perspective exploded view of the LED lamp of FIG. 1.
Figure 8:
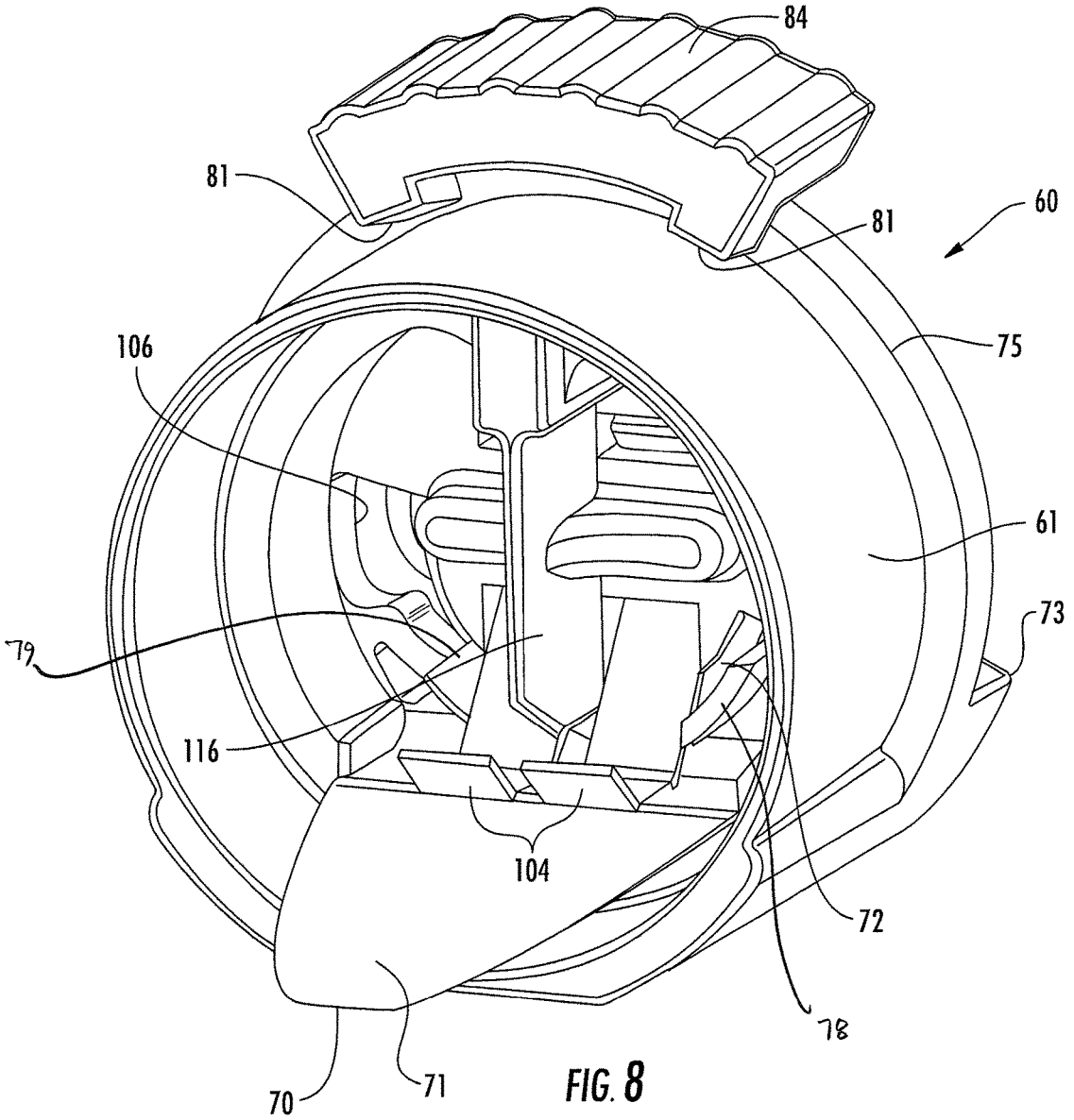
FIG. 8 is a perspective view showing an embodiment of an end cap used in the LED lamp of FIG. 1.
Figure 9:
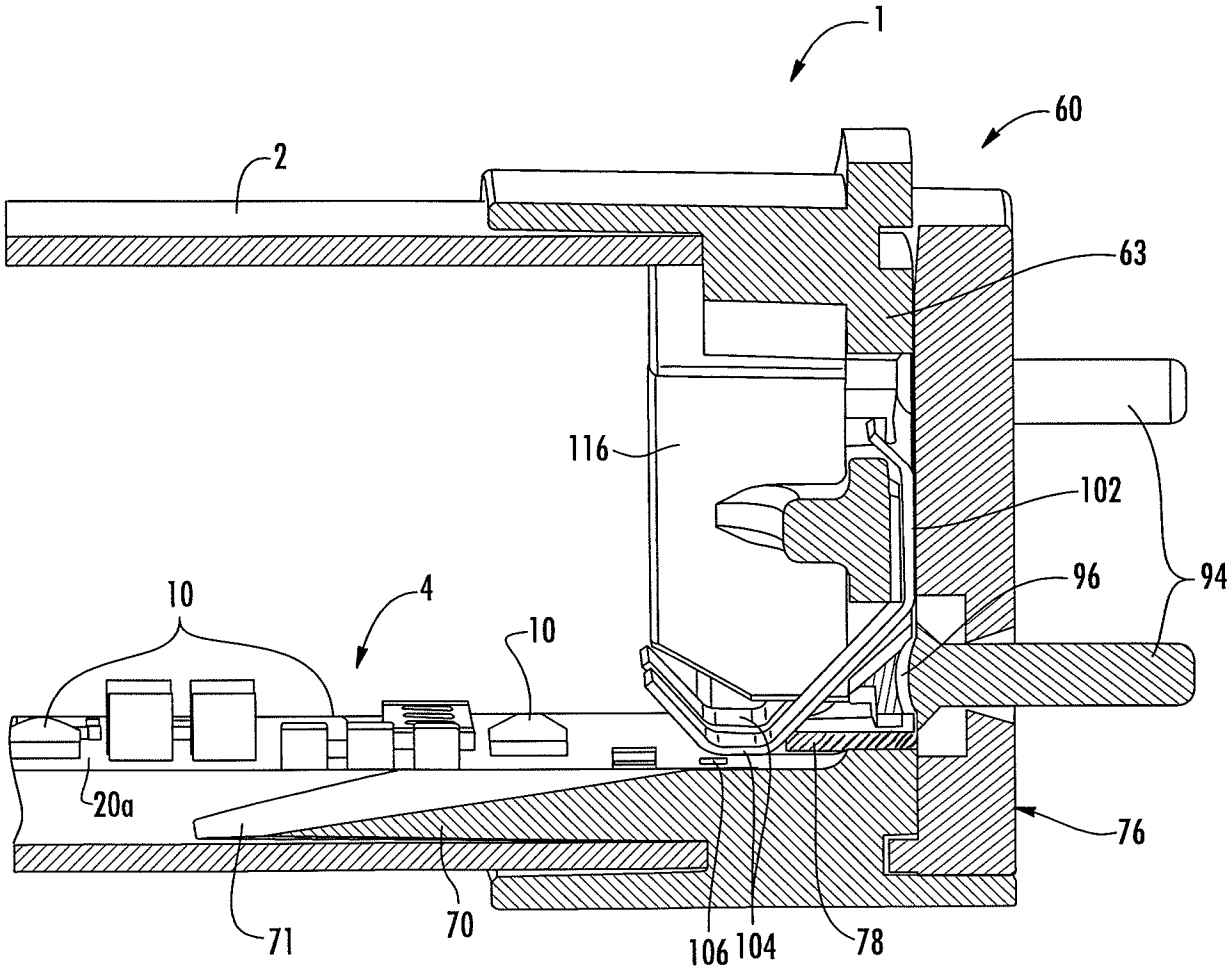
FIG. 9 is a partial section view of the LED lamp of FIG. 1.
Figure 10:
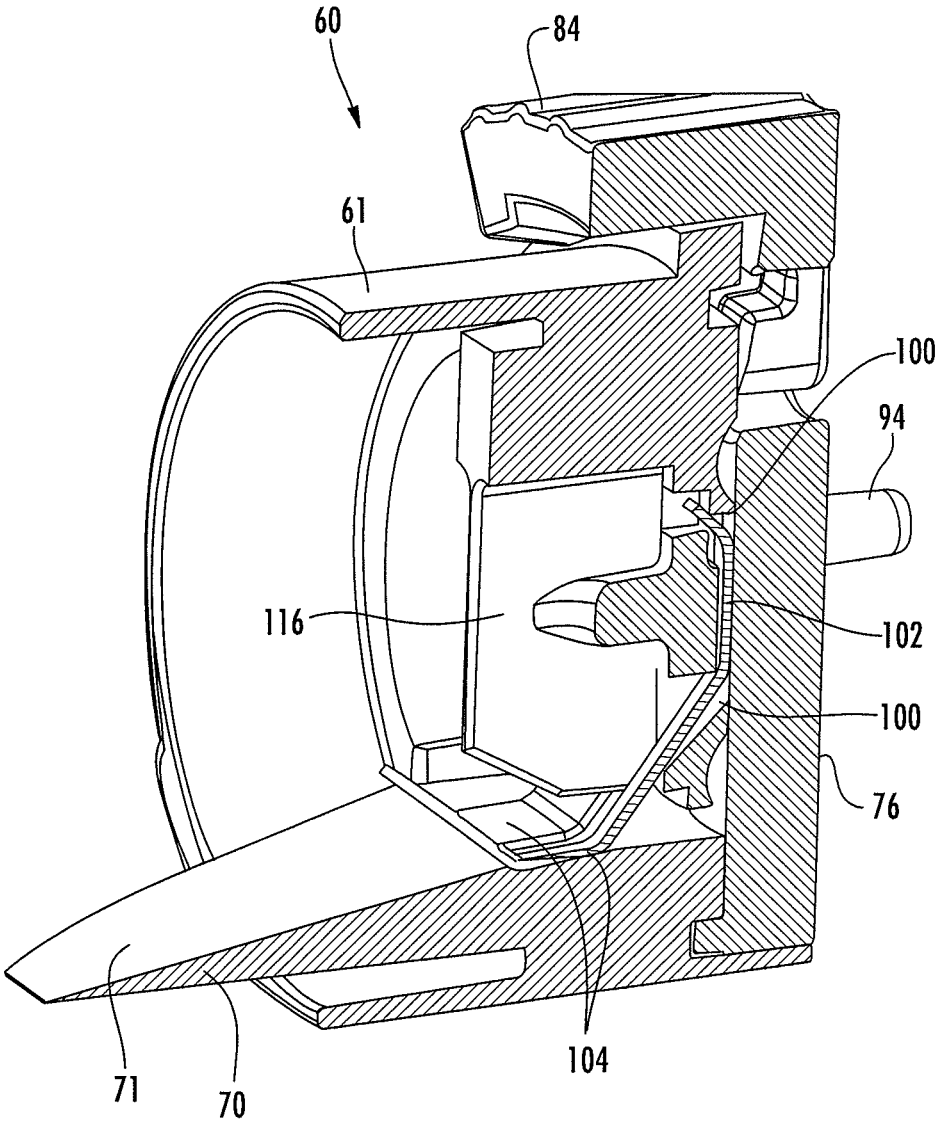
FIG. 10 is a partial section view of the end cap of FIG. 8.
Figure 11:
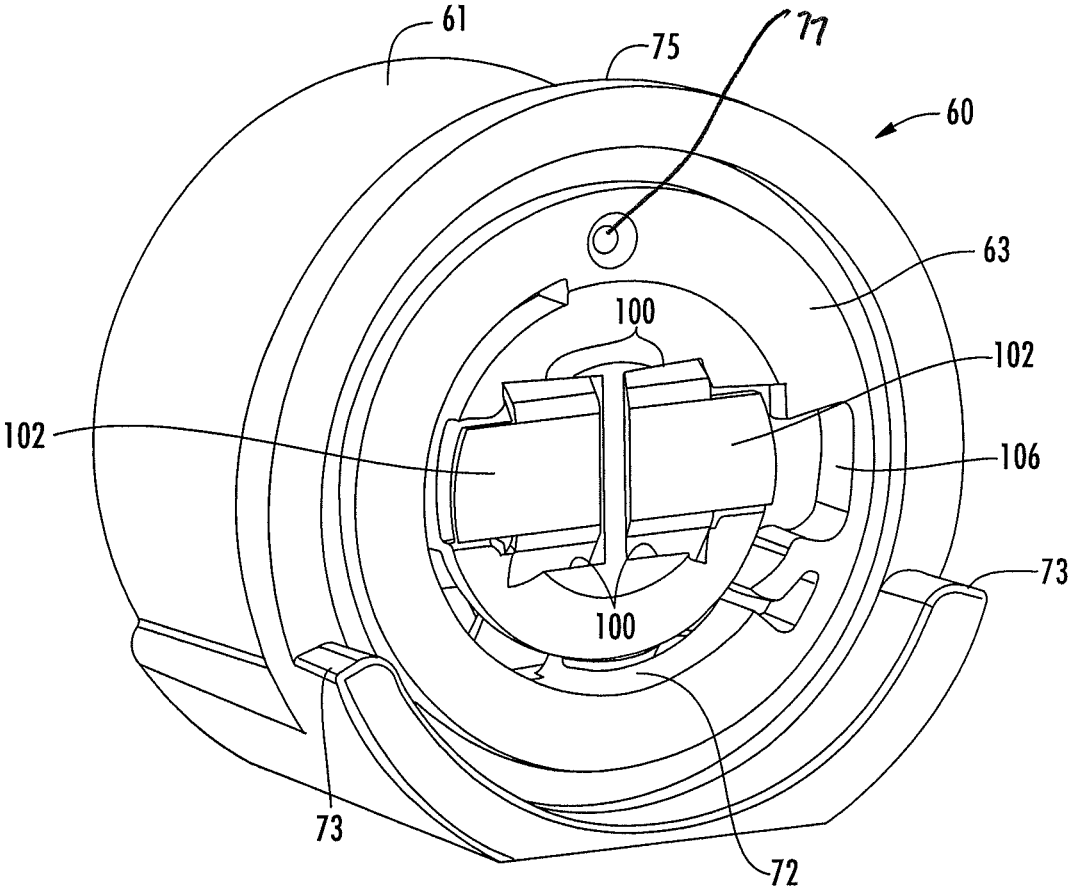
FIG. 11 is a perspective view of the end cap of FIG. 8.

In one embodiment the LED lamp 1 comprises an optically transmissive tube 2 that retains the LED assembly 4 and that acts as a lens for transmitting light from the lamp. The tube 2 covers the LED assembly 4 and creates a mixing chamber 6 for the light emitted from the LEDs 10. In the drawings the tube 2 is shown as transparent in order to show the interior structure of the lamp. In actual use the tube 2 may be provided with a diffuser layer or layers, as shown in FIG. 5, such that the tube 2 is not transparent or not completely transparent. The light is mixed in the chamber 6 and the tube 2 diffuses the light to provide a uniform, diffuse, color mixed light pattern. The tube 2 may be made of glass, molded plastic or other material and may be provided with a light diffusing layer or layers. The light diffusing layer may be provided by etching, application of a coating or film, by the translucent or semitransparent material of the lens, by forming an irregular surface pattern during formation of the lens or by other methods. In one embodiment the tube 2 comprises a glass tube that is etched, represented by cross hatching 12 in FIG. 5, on an inside surface to provide a first diffusing layer. The outside surface of the tube 2 may also be provided with a diffusing layer 14. In one embodiment the outer diffusing layer 14 comprises a carrier media impregnated with a diffusing material. In one embodiment the carrier media comprises silicone and the diffusing layer comprises silica particles. In some embodiments the silica may comprise between approximately 2-4% percent by weight of the silica/silicone coating. In one embodiment the silica may comprise approximately 3% percent by weight of the silica/silicone coating. In other embodiments the diffuser material may comprise $TiO_2$ or other diffusive material. The coating may be applied by spray, dipping or other process. It has been found that a tube having two diffusing layers provides high optical efficiency and prevents pixilation of the LED light source. In some embodiments the outer diffusing layer 14 may be provided as a film applied to the tube rather than as a coating. The film layer may comprise a cylindrical PET film tube into which the tube 2 is inserted. The PET tube may be heat shrunk to the exterior of tube 2. The PET film may include a diffuser material that is mixed with the PET material and is extruded with the PET to create a film having the desired diffusive qualities. The silicone coating and the PET film provide a shatterproof coating in addition to providing additional diffusion. The diffuser layers may be arranged in other embodiments than that shown in FIG. 5 to obtain other light patterns, intensities, mixing or the like. The silicone layer may be provided without the diffuser elements.

In one embodiment the tube 2 has a generally circular cross-section and has a length and a diameter suitable for use in existing light fixtures that use tombstone connectors. For example, in one common application the tube has a diameter of approximately 1 inch and a length that together with the end caps 60 is sized to fit into a 48 inch light fixture housing. While a specific length has been described it will be appreciated that the lamp may be made in any suitable length including standard and non-standard lengths. Moreover, while a standard one inch diameter lamp is described the lamp may be made in any suitable diameter including standard and non-standard diameters. While a circular tube has been described the tube may also be formed in other cross-sectional shapes such as an oval, other rounded shape, faceted, squared off or other non-circular profile.

Figure 30:
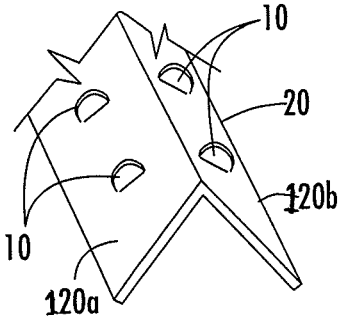

The LED lamp 1 comprises an LED assembly 4 that may be supported by and secured in the tube 2. The LED assembly 4 may comprise a plurality of LEDs or LED packages 10 that are mounted on a substrate 20. The LEDs 10 may extend the length of, or substantially the length of, the tube 2 to create a desired light pattern. The LEDs 10 may be arranged such that the light pattern extends the length of, or for a substantial portion of the length of, the tube 2 and emits a similar light pattern as a traditional fluorescent bulb. While in one embodiment the LEDs 10 extend in a line for substantially the entire length of the tube 2, the LEDs 10 may be arranged in other patterns and may extend for less than substantially the entire length of the base if desired. For example, the LEDs may be disposed along the edges of the supporting substrate 20 and directed toward the middle of the lamp. The LEDs may be directed into a waveguide. The substrate may have a multi-faceted support surface where the faces extend at angles relative to one another. For example as shown in FIG. 30 the substrate 20 may have an A-shape where two faces 120*a* and 120*b* extend at angles relative to one another and support LEDs 10 such that the LEDs project light from different planes.

The LEDs 10 may be mounted on a substrate 20 that provides physical support for the LEDs 10 and provides an electrical path for providing electrical power to the LEDs 10. The electrical path provides power to the LEDs 32 and may comprise the connectors 94 to a power source, substrate 20 and intervening lamp electronics 22. The substrate 20 may comprise a flex circuit 20*a* where the flex circuit 20*a* may comprise a flexible layer of a dielectric material such as a polyimide, polyester or other material to which a layer of copper or other electrically conductive material is applied such as by adhesive. Electrical traces are formed in the copper layer to form electrical pads for mounting the electrical components such as LEDs 10 and lamp electronics 22 on the flex circuit and for creating the electrical path between the components. In other embodiments the substrate 20 may comprise a PCB such a PCB FR4 board. A PCB FR4 board comprises a thin layer of copper foil laminated to one, or both sides of an FR4 glass epoxy panel. The FR4 copper-clad sheets comprise circuitry etched into copper layers to make the PCB FR4 board. In both the PCB FR4 board and the flex circuit the copper metal layer is supported on a low thermally conductive layer, either a glass epoxy panel or a polyimide layer, where the LEDs are mounted in the enclosure on the LED board without a heat sink.

The copper layer of the PCB FR4 board or flex circuit may be covered by a cover coat that may be a thin paint later or soldermask that is primarily used to position the components during the reflow process. The copper layer is thermally exposed in that this cover coat layer is not thermally insulating and heat may be transferred from the copper layer to the surrounding air. Other embodiments of a flex circuit or PCB FR4 board may also be used.

Figure 23:
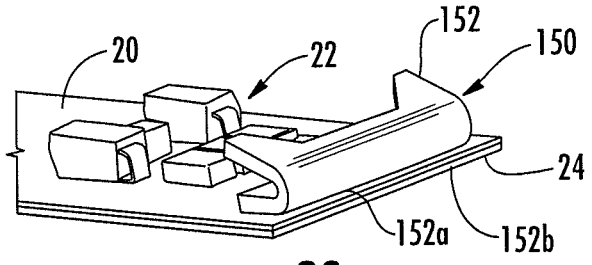
FIGS. 23-25 and 30 are partial perspective views of embodiments of the LED assembly usable the LED lamp of the invention.
Figure 24:
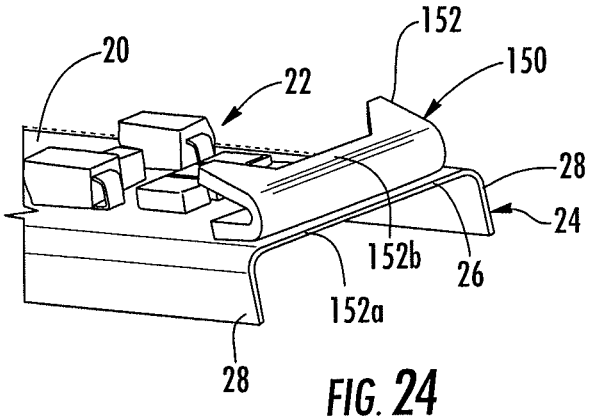
Figure 25:
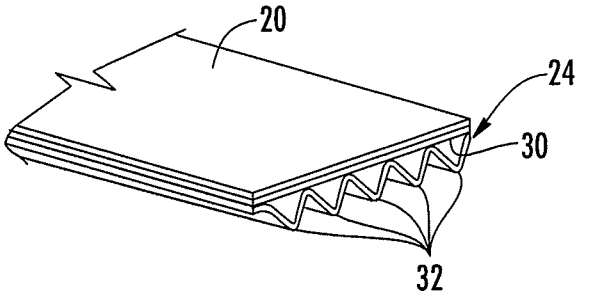

In some embodiments the flex circuit 20*a* may be supported on a base 24 where the base 24 may be made of a rigid, thermally conductive material such as aluminum. While aluminum may be used, other rigid, thermally conductive materials may be used to form the base 24. While the base 24 may be a planar member as shown in FIG. 23, the base may have a form that creates a generally planar or flat surface for supporting the flex circuit 20*a* but comprises a non-planar reinforcement structure. For example, in one embodiment the base 24 may comprise a flat member 26 that supports the substrate 20 and longitudinally extending ribs or flanges 28 as shown in FIG. 24. The ribs 28 provide structural rigidity to the base 24 such that the base 24 does not flex or bend. In other embodiments the base 24 may comprise a planar support member 30 reinforced by a formed reinforcement structure such as accordian ribs 32 as shown in FIG. 25. The base may be formed by extrusion, a stamping process or the like. The substrate 20 may be secured to the base 24 such as by adhesive, fasteners or the like. While ribs may be used in some embodiments to add rigidity to the base 24, the base 24 may comprise a planar member without a reinforcement rib, as shown in FIG. 23, where, for example, the thickness of the base provides sufficient rigidity for the lamp. While in some embodiments a base may be used in other embodiments the flex circuit may comprise the substrate and may be used without an additional base.

The LEDs 10 may be provided in a wide variety of patterns and may include a wide variety of different types and colors of LEDs to produce light in a wide variety of colors and/or light patterns. Example embodiments of interfacing one or more LEDs to AC-output lighting ballasts are described in a related U.S. patent application entitled "LED LIGHTING APPARATUS FOR USE WITH AC-OUTPUT LIGHTING BALLASTS" by Zhang et al., Ser. No. 13/943,455, the disclosure of which is incorporated by reference herein in its entirety. Example embodiments of interfacing LED strings to fluorescent emergency lighting ballasts are described in a related U.S. patent application entitled "EMERGENCY LIGHTING CONVERSION FOR LED STRINGS" by McBryde et al., Ser. No.13/943,376, the disclosure of which is incorporated by reference herein in its entirety. One embodiment of a LED lamp and suitable LED structure is shown and described in U.S. patent application Ser. No. 12/873,303 entitled "Troffer-Style Fixture" filed on Aug. 31, 2010, which is incorporated by reference herein in its entirety. In one embodiment the LEDs are positioned at regular intervals in a repeating pattern. For example in one embodiment XH-G LEDs manufactured and sold by CREE INC. may be used. The LEDs may be arranged in a line at spaced intervals of 10-11 mm over the length of the substrate 20 where the substrate 20 extends for the length of tube 10. For a 48 inch lamp in some embodiments between approximately 80 and 200 LED may be used, and more particularly between about 100 and 150 LEDs may be used, and, in one embodiment of a 48 inch lamp, approximately 105 LEDs may be used. In other embodiments 105 XQB LEDs manufactured and sold by CREE INC. may be used to create the LED assembly. The spacing and number and types of LEDs may vary to change the performance characteristics of the lamp. The lamp may be operated at between approximately 10 W to 300 W but more particularly may be operated between 18 W and 24 W.

A 48 inch lamp includes a tube 2 and substrate 20 that are slightly smaller than 48 inches to allow room for the end caps 60 such that the flex circuit may be approximately 46 inches long. It will be appreciated that the production of a 46 inch long flex circuit may be technologically difficult or cost prohibitive. In some embodiments the 46 inch flex circuit 20*a* may be created using a plurality of smaller identical flex subcircuits 20*b* that are physically and electrically coupled to one another to create a flex circuit of the desired length. For example, with existing commercially available technologies the length of a flex circuit may be limited to approximately 19 inches. Thus, to create a 46 inch flex circuit three smaller identical flex subcircuits 20*b* are used that are physically and electrically coupled to one another where each subcircuit 20*b* is approximately 15-16 inches in length. While a plurality of smaller flex subcircuits coupled together to form a larger flex circuit may be used, a single large flex circuit may be used where practical.

Flex circuits are typically formed in a long ribbon where the ribbon comprises a plurality of identical flex circuits. The ribbon may be cut to a desired length. Thus, for example, to create a 46 inch flex circuit a continuous ribbon of identical 15-16 inch subcircuits is created where the ribbon is cut every three subcircuits to create a single flex circuit of approximately 46 inches (composed of three 15-16 inch identical subcircuits) suitable for use in a 48 inch lamp.

In some applications the electronics 22 for the LEDs 10 are mounted to the flex circuit 20*a* at one or both ends of the flex circuit and the LEDs are evenly spaced along the length of the flex circuit. In some embodiments some of the electronic components may be larger than the desired spacing between the LEDs such that the placement of the electronic components on the flex circuit may affect the spacing between the LEDs 10. In some embodiments the difference in spacing is visually noticeable. For example, in one embodiment the desired spacing between the LEDs 10 may be approximately 10-11 mm as previously described. In some applications electrical components, for example a large inductor 23, may have a footprint that is larger than 11 mm such that the component may not fit between two evenly spaced adjacent LEDs.

Figure 33:
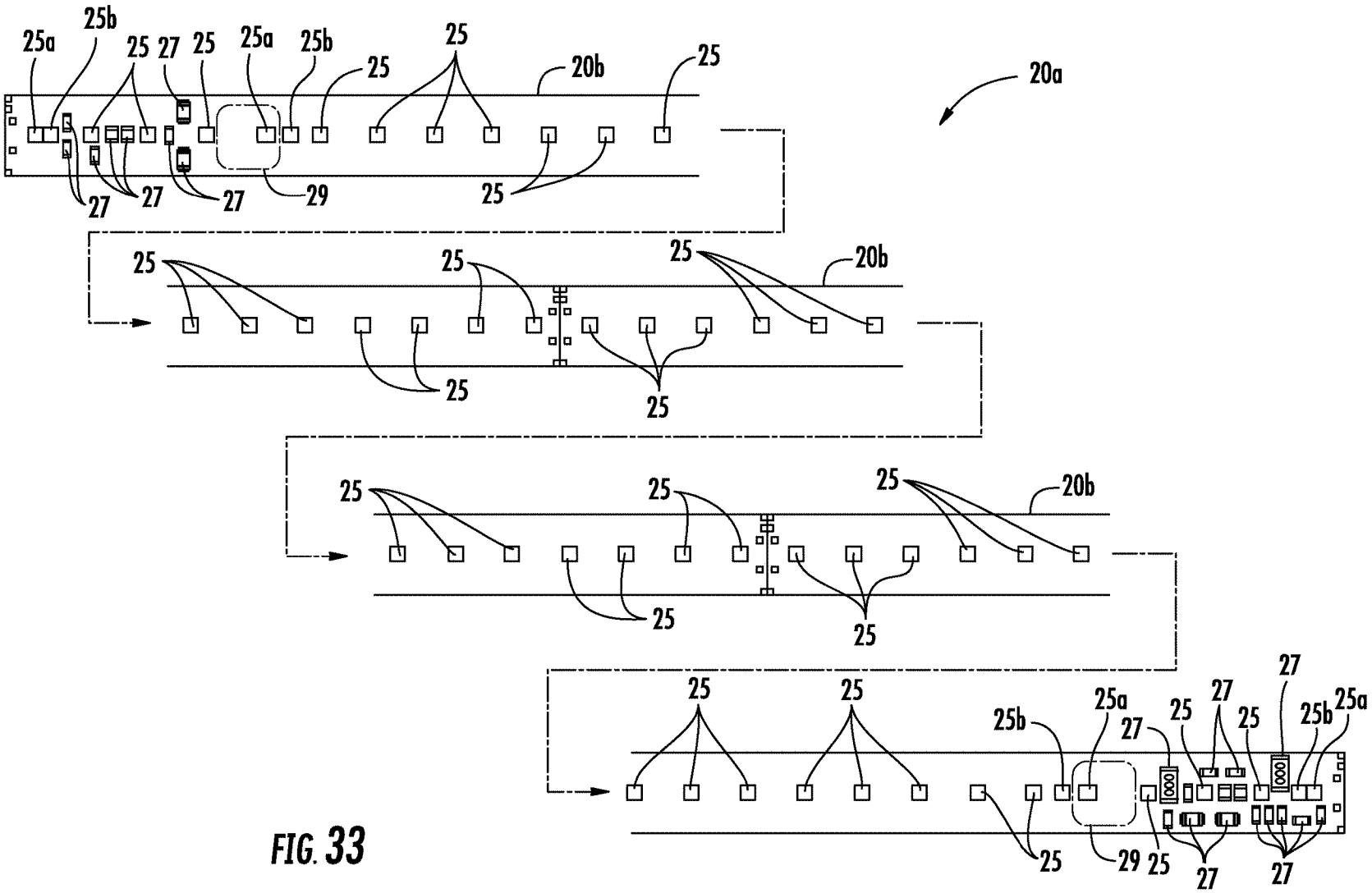
FIG. 33 is a plan view of a flex circuit usable in the lamp of the invention.

To minimize the visual effect of such components on the emitted light pattern, the flex circuit 20*a* may be provided at certain locations with two electrical pads arranged in parallel with one another where the two pads comprise a primary pad that is evenly spaced from the adjacent pads and a spare pad that is spaced at a different distance from the adjacent pads. One or the other of the coupled pads may be used to vary the spacing of the LEDs 10 slightly to accommodate other components. Referring to FIG. 33 an embodiment of a flex circuit is shown without the components such as LEDs 10 and LED electronics 22 attached to the flex circuit. Pads 25, 25*a*, for receiving the LEDs 10, are provided along the length of each of the three subcircuits 20*b* where the pads 25, 25*a* are substantially evenly spaced from one another along the length of the entire circuit 20*a*. At the ends of each of the subcircuits 20*b* pads 27 are provided for mounting components 20 of the electronics for the LEDs 32. While the components 20 may be mounted only at the ends of the circuit 20*a*, each subcircuit 20*b* is provided with the identical pads because each of the subcircuits 20*b* produced on a ribbon are identical. Typically, the component pads 27 at the ends of the circuit 20*a* are used and the component pads (not shown) formed in the center of the circuit remain unused. As previously explained, some components may be too large to fit between the evenly spaced LED pads 25, 25*a*. For example, reference is made to line 29 that represents the mounting location for a large electronic component such as a large inductor. As is apparent from the location of line 29 the inductor would cover the evenly spaced pad 25*a* that is inside of the line 29. While the LED on pad 25*a* may be eliminated, eliminating the LED may create a dark spot that is visible during operation of the lamp. To avoid this problem a second or spare pad 25*b* is provided that is electrically coupled in parallel with the primary pad 25*a*. The spare pad 25*b* is placed outside of the mounting area 29 as close to the desired position as possible. An LED may be mounted on the spare pad 25*b* with the primary pad 25*a* being unused to allow sufficient space for component 23. Where components do not interfere with the evenly spaced placement of the LEDs such as in the center of the circuit, the primary pad is used to mount the LEDs (and the spare pad is unused) such that the spacing of the LEDs is consistent across the circuit.

This technique may also be used to accommodate other components of the lamp in addition to electrical components where the placement of the LEDs may interfere with the other components. In some embodiments the mounting structure for mounting the end caps 20 to the tube 2 and to the LED assembly 4 may interfere with the placement of the outermost LEDs, as will be explained. To accommodate the mounting structure the outermost LED pads may be arranged in a primary/spare parallel pair 25*a*, 25*b* where the spare pad 25*b* may be used to create additional space for the mounting structure. The use of primary/spare parallel pads may be used in any location along the substrate where the location of the LEDs may have to be varied from the evenly spaced primary locations. In embodiments where the LEDs do not have to be evenly spaced, or where the spacing of the LEDs is not affected by other components, or where the circuit is not made of a plurality of identical subcircuits the use of primary/spare parallel pads may be eliminated. For example, in one embodiment the lamp electronics may be mounted on the end caps rather than on the substrate 20. Further, in some embodiments the primary locations may not be evenly spaced. The use of spare pads coupled in parallel to selected ones of the primary pads may be advantageously used where in some circumstances LEDs may need to be mounted in alternate secondary locations.

In some embodiments the substrate 20 such as the flex circuit 20*a* or PCB FR4 board may be mounted directly to the tube 2. In one embodiment the substrate 20 may be mounted directly to the tube 2 using an adhesive. For example an adhesive, epoxy or other similar bonding agent (collectively "adhesive") may be applied to one side of the tube along the length of the tube. The adhesive may be applied as spaced drops or it may be applied as a line of adhesive. The substrate may be inserted into the tube with the back side of the substrate facing the adhesive. The substrate is pressed against the adhesive and the adhesive cures to fix the substrate against the tube. In embodiments where a base is used to support the substrate, the base may be adhered to the tube. Further, the adhesive may be applied to the substrate or base rather than to the tube.

In one embodiment, an elongated arm 50 is inserted into the tube 2 from one open end of the tube as represented by arrow A in FIG. 26A. The arm 50 includes a dispenser 52 for applying adhesive 54 to the tube 2 as the arm 50 is inserted through the tube 2. The arm 50 further includes a clamp 56 at the free end thereof for grabbing a first end of a substrate 20 loaded with LEDs 10 and other lamp electronics. When the arm 50 reaches the opposite end of the tube 2 one end of the substrate 20 is grasped by the clamp 56, FIG. 26B. The arm 50 is removed from the tube 2 in the direction opposite to the insertion direction and pulls the substrate 20 populated with LEDs 10 through the tube 2 as represented by arrow B in FIG. 26C. The substrate 20 may be held under tension between the arm 50 and a second support 58 such that the substrate 4 is suspended over the adhesive 54 that was previously deposited on the tube 2 as shown in FIG. 26D. The arm 50 and support 58 are moved relative to the tube perpendicular to the adhesive to place the substrate 4 against the adhesive 54 as shown in FIG. 26E. The substrate 20 may be reciprocated on the adhesive to spread the adhesive over the surface of the substrate. Any suitable adhesive may be used including but not limited to a UV cured adhesive, a heat cured adhesive, a two part epoxy or other bonding agent.

To facilitate the explanation of the structure of the lamp, the side of the lamp behind the LEDs 32 is referred to as the back of the lamp and the side of the lamp facing the LEDs 32 is referred to as the front of the lamp. In the drawings the bottom portion of the lamp is the back of the lamp and the top portion of the lamp is the front of the lamp. The lamp is shown in the drawings with the LEDs 32 facing upward, but in a typical use the lamp is located in a ceiling fixture where the LEDs 32 face downward. Thus, in a typical use the front of the lamp faces outwardly and downwardly from the fixture and the back of the lamp faces inwardly and upwardly. The horizontal centerline of the lamp is a theoretical plane that is at the center or diameter of the tube and is parallel to the substrate 20. The height of the tube is the vertical distance between the back of the tube and the front of the tube along an axis that is generally at a right angle to the horizontal centerline.

As illustrated in the figures the substrate 20 is arranged in the tube 2 such that it is positioned offset from the horizontal centerline of the tube 2 such that the substrate is disposed closer to the back of the tube than the front of the tube. Locating the substrate 20 offset from the centerline of the tube, provides a larger mixing chamber in front of the LEDs and provides for more backlight due to the light reflecting towards the back of the tube from the diffuse tube. The substrate 20 is arranged such that it is disposed at a distance from the front of the enclosure that is preferably below the horizontal centerline of the tube 2. In some embodiments the substrate 20 is more than 66% of the height of the tube from the front of the tube, in others embodiments the substrate 20 is more than 75% of the height of the tube from the front of the tube, in other embodiments the substrate 20 is more than 85% of the height of the tube from the front of the tube, and in some embodiments the substrate 20 is more than 90% of the height of the tube from the front of the tube. Another mechanism for effectuating this mixing and increased backlight is to make the width of the substrate 20 narrower relative to the width of the tube. As the width of the substrate is decreased the board will sit lower in the tube, i.e. closer to the back of the tube. A narrower substrate 20 also allows more light to be emitted from the tube as backlight because the narrower substrate blocks less light. Similar to where the board sits in the tube, the width of the tube 2 can also be decreased to less than 50% of the diameter of the tube, less than 33% of the diameter of the tube, less than 25% of the diameter of the tube, or less than 15% of the diameter of the tube. The tube 2 is arranged such that to the lateral sides of the LEDs 10 there is no structure to block light emitted by the LEDs. In some embodiments the longitudinal edges of the substrate 20 engage the sides of the tube 2. The planar LED substrate 20 and base 24, if used, do not obstruct light emitted laterally from the LEDs 10. The tube 2, in some embodiments, may be configured such that the width of the tube 2 at its widest portion is larger than the width of the substrate 20. In other words the ratio of the substrate width to the maximum tube width is less than 1. As a result, light may be emitted from the tube 2 as backlight that is not blocked by the substrate 20. As a result of this arrangement some of the light generated by the LEDs 10 is directed as backlight in a direction behind the plane of the LEDs 10. Some of the light emitted by the LEDs may be emitted directly as backlight while other light emitted by the LEDs may be reflected off of the tube and emitted as backlight. The backlight creates a light distribution pattern that is similar to the light distribution pattern of a traditional fluorescent system. It will be understood that in a traditional fluorescent system the fluorescent tube generates light over 360 degrees. As a result, some of the light generated by the fluorescent tube is reflected from the fixture housing. The backlight generated by the LEDs 10 may be directed toward and reflected from the fixture housing such that the LED lamp of the invention provides a visual appearance similar to the of a fluorescent tube. Such an arrangement provides an LED lighting system that provides a light distribution pattern that is similar to legacy fluorescent tube lights. In some embodiments, the LEDs may be center mounted with greater side emitting optical profiles such as CREE XPQ LEDs. In some embodiments a prismatic lens or parabolic reflectors may be used to create a desired light distribution. Further, combinations of different types of LEDs may be used to create a variety of light patterns and intensities. Moreover, the light distribution can also be effected by the shape of the tube which can be circular oval or other shapes. While the arrangement of the substrate 20 in the enclosure has been described with respect to a generally cylindrical tube 2, the principles also apply to a tube having a different cross-sectional shape. In non-circular cross-sections, the height of the tube may be considered the distance between the front and back of the optically transmissive enclosure and the width of the tube may be considered the distance transverse to the height at the enclosure's widest part.

In embodiments using a flex circuit or a PCB FR4 board mounted in a tube as described herein, the copper of the flex circuit 20 or PCB FR4 board provides sufficient heat transfer from the LEDs to the air in the interior of tube 2 that a heat sink structure is not used. The LEDs may operate at a steady state where heat is transferred from the flex circuit or PCB such as a PCB FR4 board to the air in the tube and to the ambient environment at a rate that a heat sink is not required. The LEDs are driven at a relatively low current such that the amount of heat generated by the LEDs is low enough that the heat transfer from the LEDs via the flex circuit or PCB such as a PCB FR4 board is sufficient to operate the LEDs at a steady state without a heat sink structure. By using efficient LEDs operated at low current the heat generated by the LEDs may be dissipated from the LED assembly using only the copper layer in the flex circuit or PCB such as a PCB FR4 board.

The LED assembly may comprise three sets of LEDs where the LEDs of each set are connected in series with the sets connected in parallel. Approximately 35-50 LEDs may be used in each string. In one embodiment the 137 total LEDs may be operated at 137V with each LED string operating at about 77 mA. In another embodiment 120 total LEDs may be operated at about 120V with each string at 65 mA. In another embodiment 105 total LEDs may be operated at 105V with each string at 59 mA. The LED assembly uses a relatively large number of LEDs, approximately 100-150 total LEDs, operated at relatively low current such that relatively little heat is generated by the LEDs such that the metal layer in the flex circuit, PCB such as FR4 PCB board is sufficient to dissipate heat from the LEDs at a steady state operation. The LEDs may be operated at less than 100 mA and in some embodiments may operate at between approximately 30-100 mA and may be operated at between 50-80 mA. Due to operating constraints of existing ballasts and safety requirements, embodiments of the present invention have an operating voltage of about 150V or less.

In one embodiment, LEDs may be used that generate greater than about 115 Lumens per Watt (LPW). The lamp operates at least approximately 100 LPW and in some embodiments may be between approximately 100 LPW and 140 LPW and in some embodiments may be between approximately 100 LPW and 110 LPW. In a lamp as shown and described, the system efficiency loss is approximately 15% such that for a particular LPW operation of the lamp, the LEDs typically must be approximately 15%, or greater, more efficient than the efficiency of the lamp. Suitable LEDs are XQ LEDs and XH LEDs manufactured by CREE INC. The lamp operates at these efficiencies while having a correlated color temperature (CCT) of between about 3000 and 4000K and more particularly between about 3,500 and 4000K at the LPW. In one embodiment the LEDs are spaced approximately greater than 7 mm apart, such as 8-15 mm apart or about 10-12 mm apart center to center with an input power of approximately 20 Watts. A thermally exposed copper layer having a width of between approximately 12 mm and 17 mm provides good thermal control and dissipates enough heat from the LEDs to provide an efficient steady state operation at approximately 2100 Lumens output. In some embodiments the thermally exposed copper layer may be reduced to as low as 7 mm, however, the solder point temperature may increase to a level that may reduce the life of the LEDs. A thermally exposed copper layer having a width of between approximately 7 mm and 12 mm reduces lumen output to about 1900 Lumens of the LEDs.

In some embodiments 105 LEDs are used in a 48 inch lamp providing light having a CRI of between approximately 70 and 95 and more particularly between approximately 78 and 85 and in one embodiment the CRI is approximately 90. The LEDs may be operated between approximately 100 and 120 Lumens per Watt (LPW) and more particularly between approximately 100 and 110 LPW. In some embodiments the LPW of the LEDs may be greater in order to achieve a lamp efficiency of greater than about 110-115 LPW. In some embodiments the lamp may have a total Lumen output of between 1750-2500 Lumens, such as 1900-2250 Lumens. The lamp may have a total Lumen output of over 2000 Lumens, such as 2000-2250 Lumens, and in one embodiment the lamp has a total Lumen output of approximately 2159 Lumens. The lamp of the invention may have an optical efficiency of over approximately 75% and in some embodiments may have an optical efficiency of between approximately 75% and 98% and more particularly between approximately 88% and 95% and in one embodiment the efficiency is approximately 89%.

End caps 60 may be provided at the opposite ends of the tube 2 to close the interior mixing chamber 6 of LED lamp 1 and to support the electrical connectors 94 for connecting to the tombstone connectors 210 of the housing. The end caps 60 and tube 2 together define an enclosure that retains the LEDs 10. The enclosure is at least partially optically transmissive through the tube 2.

The end caps 60 are identical such that the structure and operation of one end cap will be described. The end cap 60 comprises an internal chamber 62 defined by a side wall 61 and an end wall 63 dimensioned and shaped to closely receive the tube 2. In one embodiment the tube 2 is slid into the chamber 62 and is closely received by the side wall 61. The end caps 60 may be secured to the tube 2 using adhesive, a friction fit, mechanical engagement structures, separate fasteners and/or the like. To properly position the substrate 20 relative to the end cap 60, an alignment member 70 may extend from the internal chamber 62 of end cap 60 that engages the underside of the substrate 20 to position the substrate at the proper elevation relative to the end cap 60 and to provide support a support surface 71 for the substrate 20. The alignment member 70 may have a ramped support surface 71 to guide the substrate 30 into the end cap 60. The support surface 71 may be planar to support the substrate such as flex circuit 20*a* in a flat position.

The end wall 63 defines a semicircular slot 72 for receiving the control member 76. The side wall 61 also comprises a bearing surface 75 on which the electrical control member 76 rides and a pair of stops 77 for limiting rotation of the control member 76 relative to the end cap 60 as will be described. The rotating control member 76 is fixed to the end cap 60 such that the control member 76 may rotate relative to the end cap 60 but is otherwise fixed to the end cap 60. In one embodiment, the rotating control member 76 includes a body 77 that is disposed outside of the end cap, a spacer 78 that extends from the body 77 into the aperture 72, and a stop 79 that also extends from body 77 and into aperture 72. The stop 79 and spacer 78 may slide in aperture 72 such that the control member 76 may rotate relative to the end cap 60. The stop 79 and spacer 78 are provided with locking portions 80 that engage the interior surface of end wall 63 to retain the stop 79 and spacer 78 in the slot 72. When the locking portions 80 are positioned inside of the slot 72 the locking portions 80 are disposed behind the end wall 63. The stop 79 and spacer 78 are dimensioned such that the end wall 63 is trapped between the locking portions 80 and the body 77 of the control member 76 but the control member 76 is free to rotate relative to the end wall 63. In one embodiment, the stop 79 and spacer 78 and/or the end wall 63 may deform to allow the locking portions 80 to be inserted into the slot 72. The rotating control member 76 may be provided with a protruding area 84 that forms a lever that may be easily accessed by a user to rotate the control member 76 during installation of the lamp as will be described. The protruding area 84 may be provided with a flange or flanges 81 that create a slot or slots 82 for receiving the bearing surface 75 of the end cap 60 such that the control member 76 is also secured to the end cap 60 by the engagement of the bearing surface 75 with the flanges 81. The protruding area 84 may be knurled to enhance the user's grip on the control member and facilitate the rotation of the control member 76. The control member 76 may also use a detent 77 and tang 79 arrangement between the control member 76 and the end cap 60 to temporarily "lock" the control member relative to the end cap and to provide feedback to the user as to the proper position of the end cap. Other mechanisms for mounting the rotating member to the end caps may also be used.

The control member 76 supports a pair of pins 94 such that rotation of the control member 76 rotates pins 94. The pins 94 are mounted in apertures 96 in the body 77 and are positioned and dimensioned such that the pins 94 are able to mechanically and electrically engage the tombstone connectors 210. In some embodiments a single pin 94 may be used to complete the electrical connection where the second pin may be used only to provide physical support for the lamp in the tombstone connectors. The pins 94 may be insert molded into the control member 76 or the pins 94 may be fixed in the control member 76 using any suitable connection mechanism including a press fit, adhesive, mechanical connector or the like. The pins 94 extend through the control member 76 such that a portion of the pins communicate with the interior of the lamp to create contact pads 96.

Conductors 104 are electrically coupled to the pins 94 and to electrical contacts 106 formed on the LED substrate 20 to complete the electrical path between the pins 94 and the LED assembly 4. The conductors 104 may comprise resilient members that may be biased into engagement with contacts 106 on the LED substrate 20. The conductors 104 comprise resilient members made of an electrically conductive material such as copper. Each conductor has a first end supported in slots 100 formed in the end wall 63 of the end cap 60 such that contact pads 102 are created on the exterior of the end cap. The opposite ends of the conductors 104 extend into the internal space 62 of the end cap 60 where the conductors 104 make contact with electrical contacts 106 on the substrate 20. The conductors 104 are configured and supported such that the free ends of the conductors 104 are biased into engagement with the contacts 106. An insulator 116 may be provided between the conductors 104 to electrically insulate the conductors from one another. An electrical path may be created between the pins 94 and the substrate 20 to provide both sides of critical current to the LED assembly when the pads 96 of pins 94 are in contact with pads 102 of conductors 104 and the conductors 104 are biased into engagement with electrical contacts 106 on the substrate 20.

Figure 29:
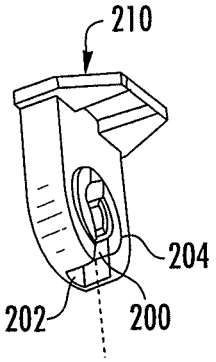
FIG. 29 is a perspective view of a tombstone connector used in a fluorescent fixture.

Referring to FIG. 29, the typical tombstone connector 210 comprises a linear slot 200 that communicates with the exterior of the connector through an opening 202. A circular slot 204 communicates with the linear slot 200 such that the linear slot bisects the circular slot. An electrical contact is located in each half of the circular slot 204 where the contacts are connected in the electrical path. The pins 94 are positioned on the lamp 1 such that they can be inserted through opening 202 into the linear slot 200 where the pins 94 are disposed at the intersection of the circular slot 204 and the linear slot 200. The control member 76 can then be rotated to move the pins 94 in the circular slot 204 such that one of pins 94 engage one of the electrical contacts of tombstone connector 210.

Because the lamp of the invention is intended to be used as a replacement for standard fluorescent tubes the pins 94 are positioned in the same relative location as the pins on a standard fluorescent tube such that the lamp of the invention may be used in standard fluorescent housings and with standard tombstone connectors. The length of the lamp 1 of the invention may also be dimensioned to fit standard fluorescent bulb length housings such that the lamp 1 extends between a pair of tombstone connectors 210 with the pins 94 extending into and engaging the tombstone connectors.

Figure 12:
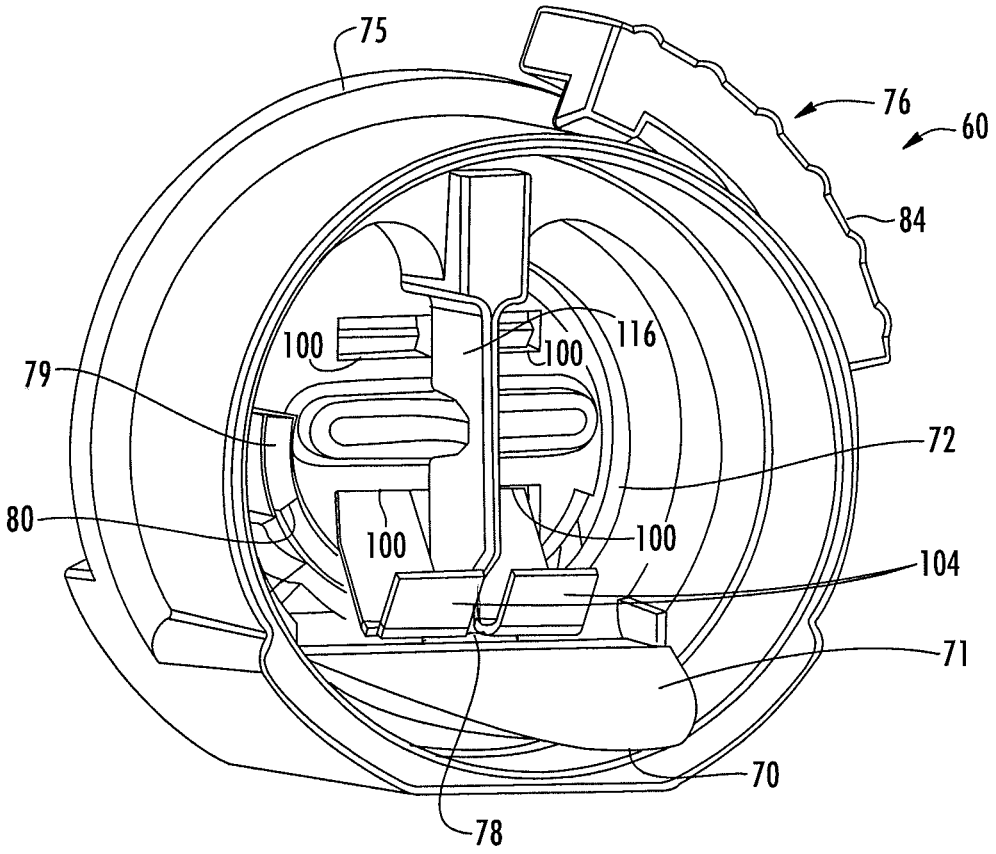
FIG. 12 is a perspective view of the end cap of FIG. 8 in a first orientation.

Operation and assembly of the end caps will now be described. To assemble the end cap 60 the conductors 104 are inserted in the slots 100 such that the distal ends of the conductors 104 are positioned in the interior 62 of the end cap 60. The control member 76 is mounted to the end cap 60 by inserting the stop 79 and the spacer 78 into the circular slot 72 and snapping the flanges 81 over the bearing surface 75. The control member 76 is constrained to rotate relative to the end cap 60. During assembly of the control member 76 to the end cap 60, the spacer 78 is disposed between the ends of the conductors 104 and the support surface 71 to move the ends of the conductors 104 away from the support surface 71 to create a gap between the conductors 104 and the support surface 71 for receiving the substrate 20. The stop 79 is inserted into opening 106 formed at the distal end of the slot 72. This position of the control member 76 relative to the end cap 60 is the assembly position and is shown in FIG. 12. The control member 76 assumes the assembly position only during assembly of the lamp. The control member 76 is prevented from assuming this position during operation of the lamp by an end user as will be explained.

The spacer 78 is used to create a gap between the support surface 71 and the conductors 104 because a flex circuit, because of its flexibility, requires a near zero insertion force. If the substrate is rigid or if a flexible substrate is mounted on a rigid base the substrate may be inserted between the conductors 104 and the support surface 71 where the rigid substrate deforms the conductors 104 to create the bias between the conductors and the substrate.

With the control member 76 in the assembly position, the end cap 60 is fit onto the end of the tube 2 and is secured thereto as previously described. As the tube 2 is slid into the end cap 60 the substrate 20 slides over the support surface 71 and is positioned in the gap created by spacer 78 between the conductors 102 and the support surface 71.

Figure 13:
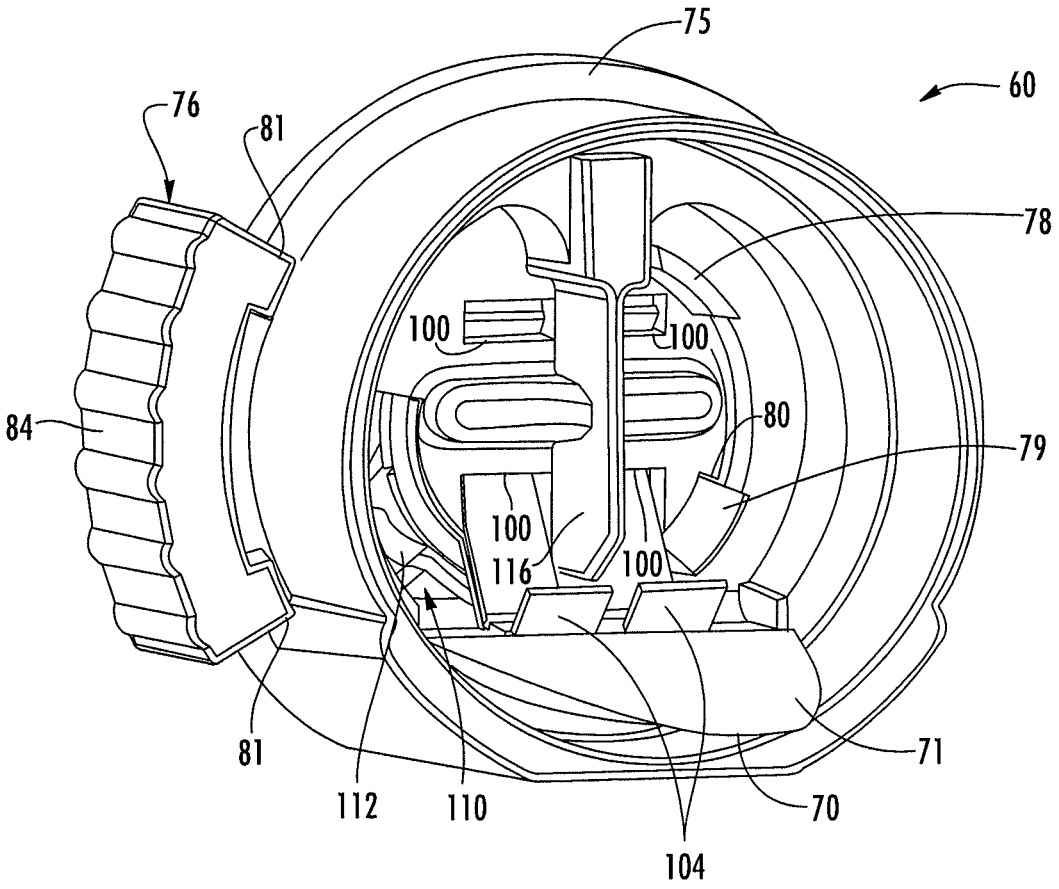
FIG. 13 is a perspective view of the end cap of FIG. 8 in a second orientation.

After the end cap 60 is mounted on the tube 2, the control member 76 is then rotated to the operational position of FIG. 13. In this position the spacer 78 is rotated from between the conductors 104 and the support surface 71 such that the conductors 104 return to the undeformed state and are biased into engagement with the contacts 106 on substrate 20. The conductors 104 maintain good electrical contact with the substrate 20 using the resiliency of the conductors 104 to bias the ends of the conductors 104 into engagement with the substrate contacts 106 and to clamp the substrate between the conductors and the support surface 71.

When the control member 76 is rotated to the operational position of FIG. 13 the stop 79 rotates in slot 72 until it passes lock 110. Lock 110 prevents the control member 76 from rotating back to the inoperative assembly position of FIG. 12 once the end cap 60 is mounted on the tube 2 during assembly of the lamp such that an end user may not inadvertently disable the lamp. The lock 110 comprises a resilient member 112 that extends into the slot 72. The resilient member 112 is deformed to an unlocked position as the stop 79 rotates past the member 112 when the control member 76 moves from the assembly position to the operational position. When the stop 79 clears the lock 110 the resilient member 112 returns to its undeformed state where it is positioned to engage the stop 79 to prevent the control member 76 from rotating back to the assembly position. In the operational position the lamp is in a position to be inserted between traditional tombstone connectors with the pins 94 disposed in a plane that is perpendicular to the substrate 20. Assembly of the end caps to the tube to create the electrical path from the pins 94 to the LED assembly 4 is accomplished without using screws, wires or soldering.

To assemble the lamp of the invention, an LED substrate 20 is populated with LEDs 10 and lamp electronics as previously described. The LED substrate 20 is inserted into the tube 2 and is secured to and supported by the tube 2 as previously described. The end caps 60 are mounted on the tube 2 as previously described and the control member 76 is rotated to the operational position to complete the assembly. Because a relatively large number of LEDs 10 are used that may be operated at relatively low power to generate sufficient lumens to comply with existing standard for fluorescent tubes, the LEDs do not generate high heat. As a result, in addition to providing the electrical connection between the LEDs and other lamp electronics the copper layer of the substrate 20 is sufficient to function as a heat sink to dissipate heat generated by the LEDs 10 to the air or other gas in the tube 2. The tube 2 dissipates the heat to the ambient environment to create a steady state temperature that does not adversely affect the operation of the LEDs.

Figure 14:
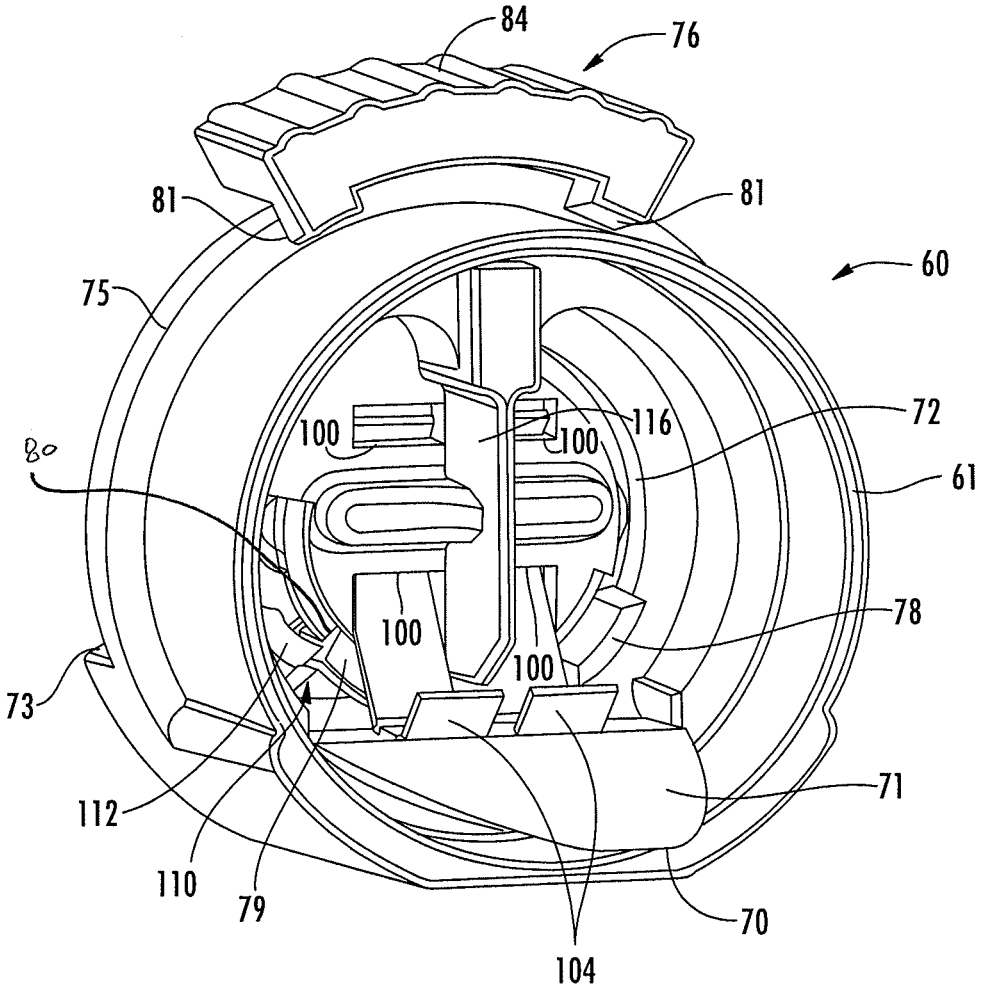
FIG. 14 is a perspective view of the end cap of FIG. 8 in a third orientation.
Figure 15:
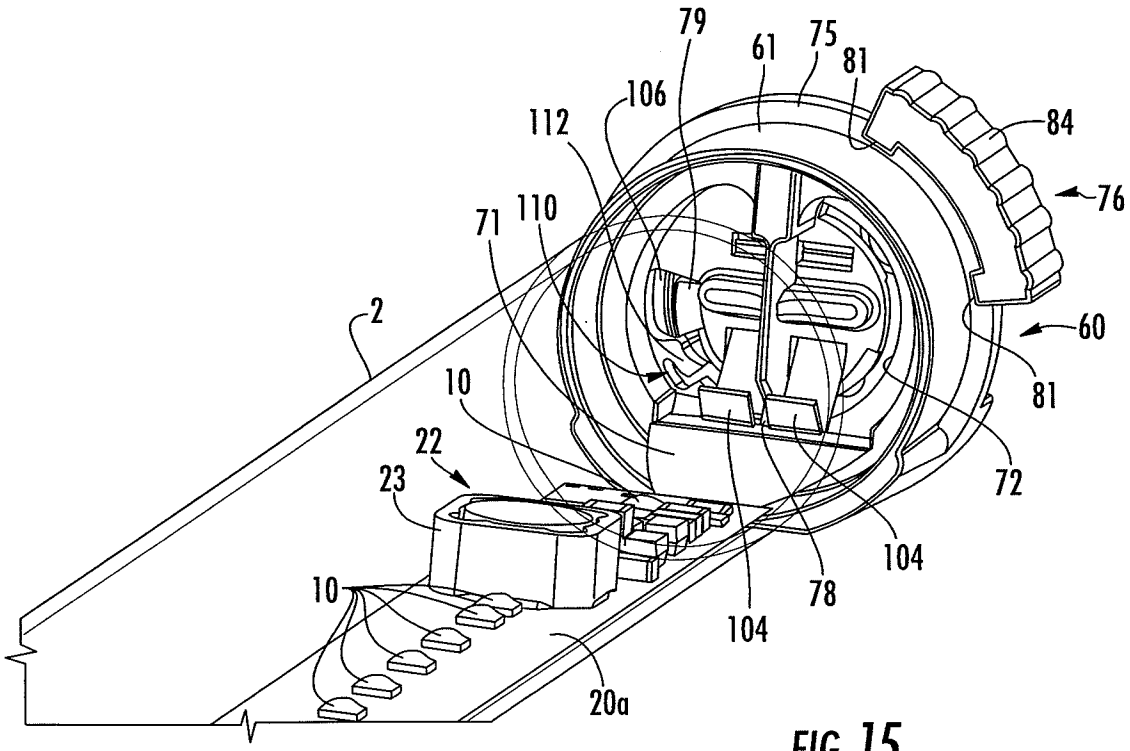
FIG. 15 is a partial perspective view of the lamp with the end cap in the first orientation and removed from the tube.
Figure 16:
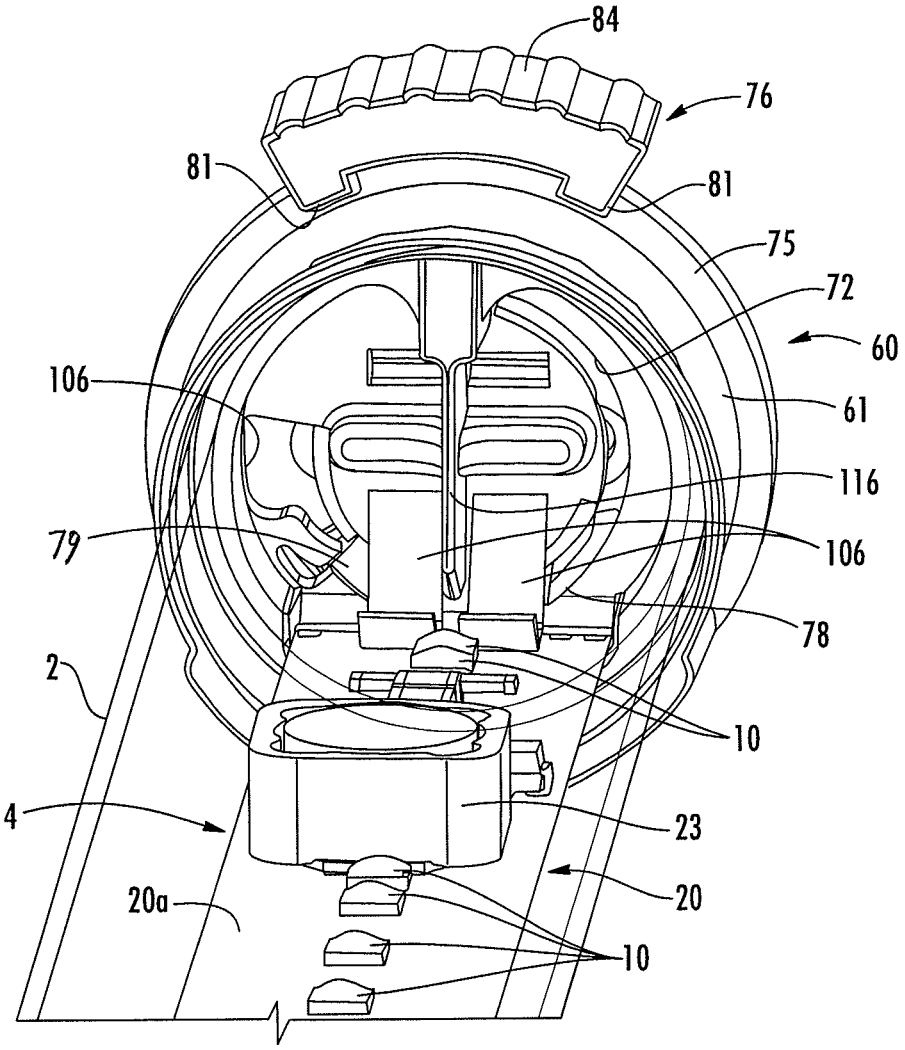
FIG. 16 is a partial perspective section view of the LED lamp of the invention in the third orientation.
Figure 17:
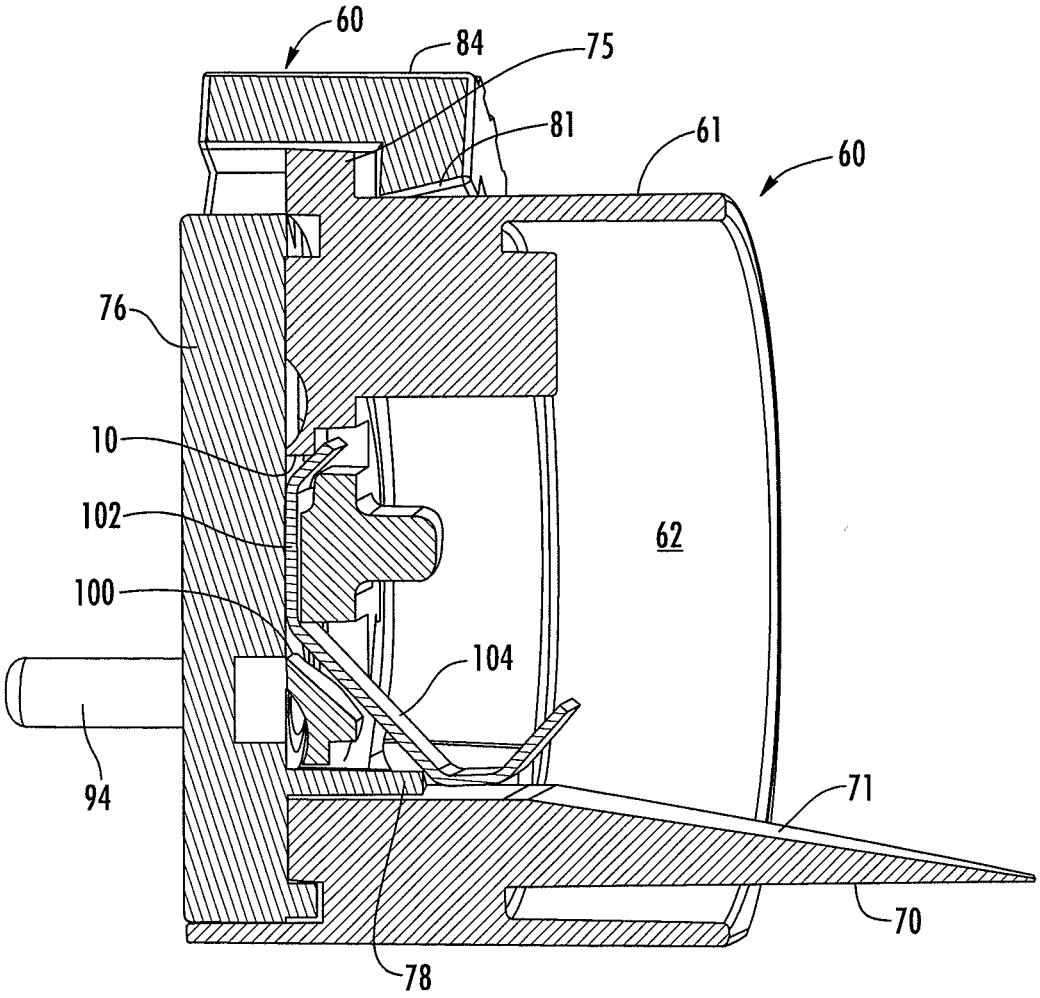
FIGS. 17 and 18 are partial section views of the end cap of FIG. 8 showing the attachment of the conductor in the end cap.
Figure 18:
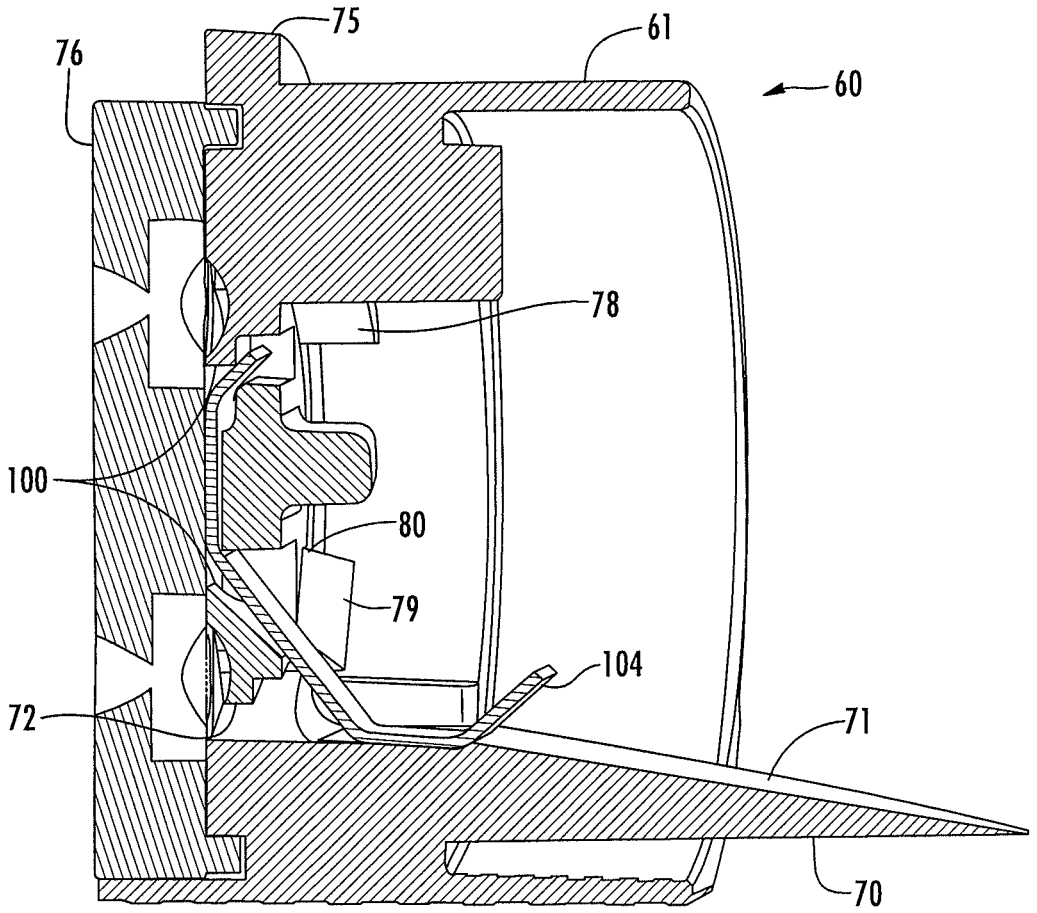
Figure 19:
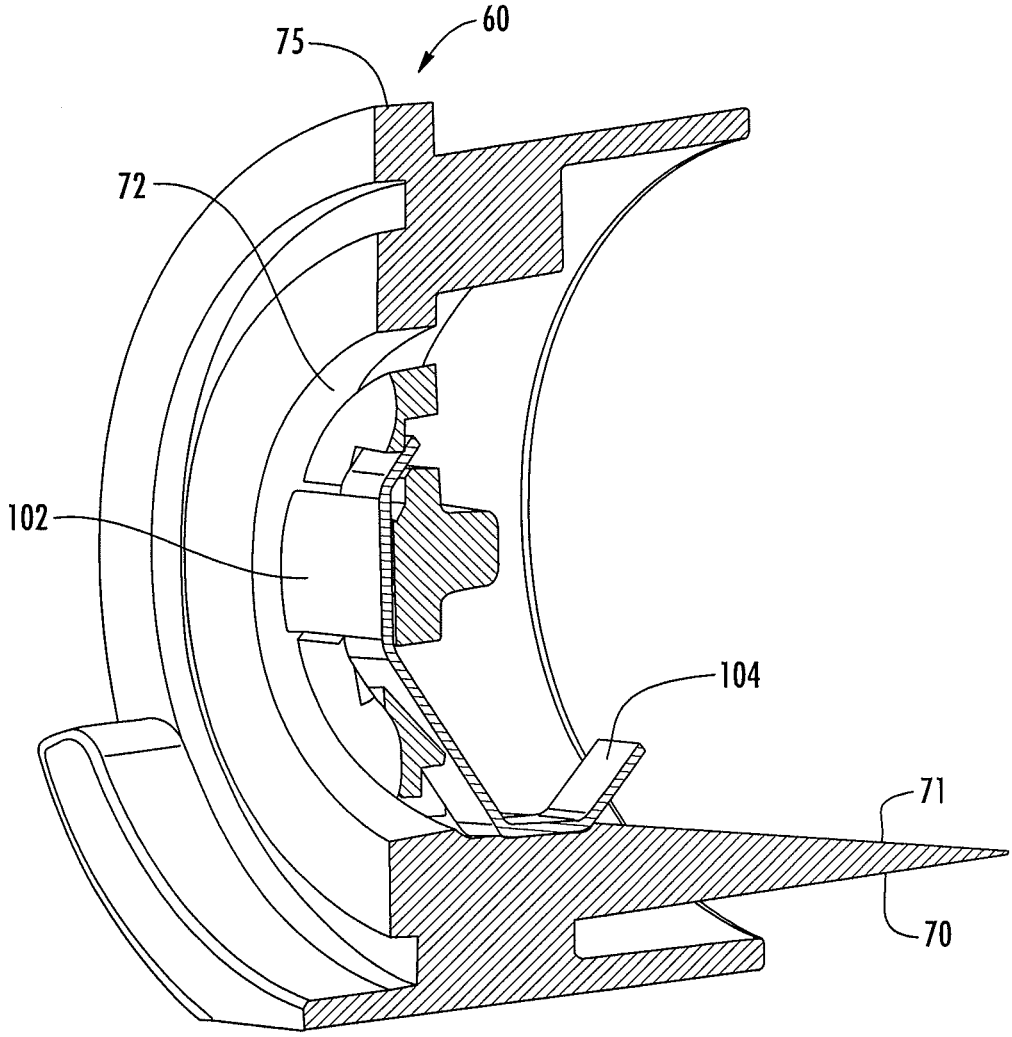
FIG. 19 is a partial section view of the end cap of FIG. 8 showing the attachment of the conductor in the end cap.
Figure 20:
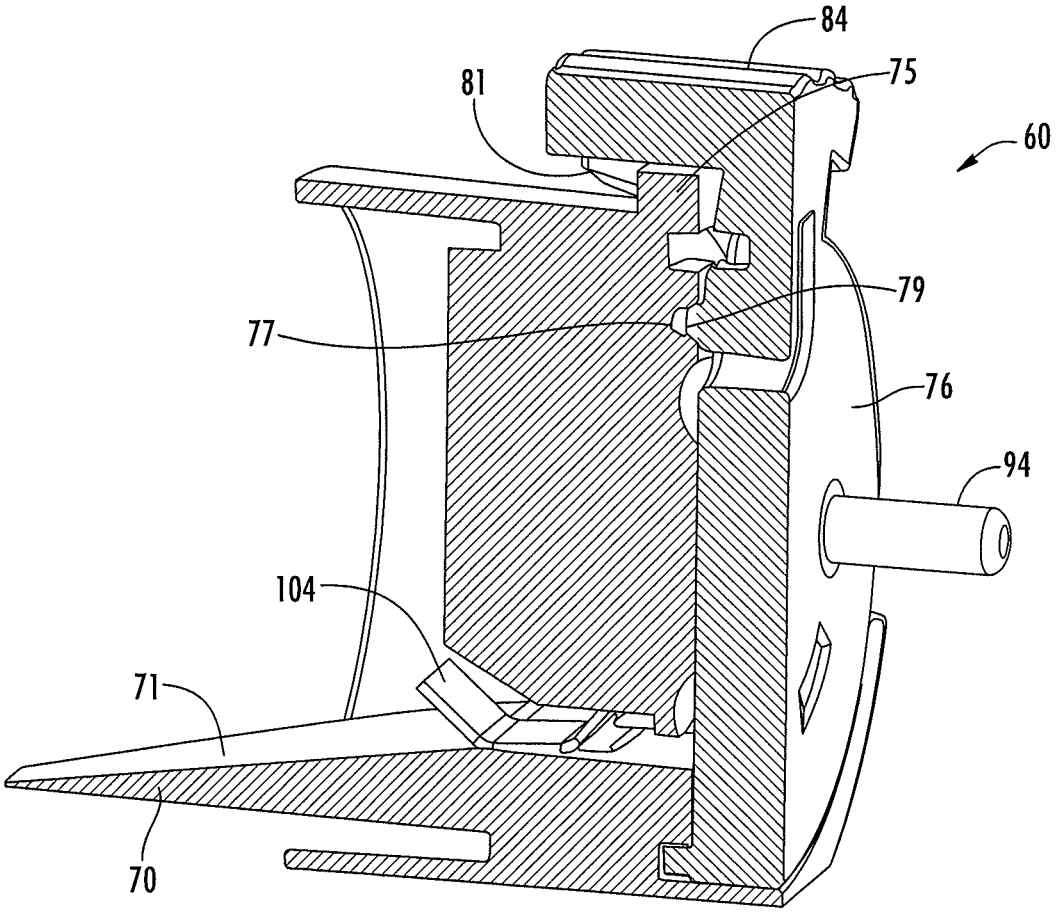
FIG. 20 is a partial section view showing another embodiment of an end cap used in the LED lamp of FIG. 1.

To retrofit an existing fluorescent fixture, the existing fluorescent tubes 213 are removed from the fixture housing. The control members 76 are positioned in the operational position of FIG. 13 such that the pins 94 are aligned in a plane that is perpendicular to the substrate 20. In a typical ceiling mount fixture the control member 76 is positioned such that the pins 94 are aligned generally vertically and the LEDs 10 face downwardly. The lamp 1 is inserted into the housing 4 such that the pins 94 are inserted into the linear slots 200 of the tombstone connectors 210. Once the lamp 100 is properly positioned in the housing and the pins 94 are seated in the tombstone connectors 210, the control member 76 is rotated 90 degrees relative to the tube 2 by the user to rotate the control member 76 and pins 90 degrees (between the positions of FIGS. 13 and 14). The pins 94 rotate in the in the circular slots 204 of the tombstone connectors 210. The tube remains stationary during the rotation of the pins. The pins 94 are rotated to engage the existing electrical contacts in the tombstone connectors 210. As the pins 94 rotate relative to the end caps 60 the pins 94 are brought into contact with the pads 102 formed on the electrical conductors 104 to complete the electrical path between the tombstone connectors and the LEDs 10. In this manner the rotation of the control member acts as a switch to disconnect the power supply from the pins until the control member 76 is rotated and the pins 94 are brought into contact with the pads 102 formed on the electrical conductors 104 to complete the electrical path. Such a switch function may be important for safety considerations. For example, United Laboratories (UL) has a test for leakage current for such lamps. It will be appreciated that in some installations of a linear lamp, the user may insert the pins sequentially such that the first set of pins on one end of the lamp are inserted into the tombstone connector (and to the source of power) while the second set of pins on the opposite end of the lamp are still exposed, outside of the second tombstone connector. The user may then insert the second set of pins into the second tombstone connector. In such a situation leakage current in the second set of pins may present a shock hazard to the user. Using the control member 76 as a switch to disconnect the power source from the lamp until both sets of pins are seated in their respective tombstone connector eliminates or minimizes the shock hazard from leakage current in the lamp.

In an alternate embodiment the electrical pads 102 formed on the exterior of the end caps 60 may be arranged, such as in an arc of a circle, such that the pins 94 are always in contact with the electrical pads 102. Because the pins 94 are rotatable relative to the tube 2, the tube 2 may be rotated relative to the pins 94 after the lamp is mounted in the housing to provide more directional light.

While the LED lamp 1 has been described herein as a retrofit of a traditional fluorescent light, the LED lamp 1 and the assembly method described herein may also be used to make new LED based fixtures. An LED lamp 1 as described herein may be manufactured as a complete subassembly and may be attached to a new housing 200 as described to create a new fixture.

In an alternate embodiment the substrate may be mounted in the lamp without being attached to the tube as shown in FIGS. 21 through 24. Like numerals are used to identify components previously described with respect to the embodiments of FIGS. 1-20. The substrate 20 and LED assembly 4 may be formed as previously described but with an engagement structure 150 mounted to each end of the substrate to mount the substrate 20 to the end caps 60. The engagement structure 150 may comprise two clips 152, one of the clips 152 being secured to each end of the substrate 20. The clips 152 may be secured to the substrate 20 by adhesive provided such an attachment does not fail under the operating conditions of the lamp. In some embodiments the clips 152 may be secured to the substrate 20 by a mechanical connector such as a rivet that engages all of the layers of the substrate 20. A rigid base 24 may be secured to the substrate 20 to further structurally reinforce the connection as shown in FIGS. 23-25.

Figure 21:
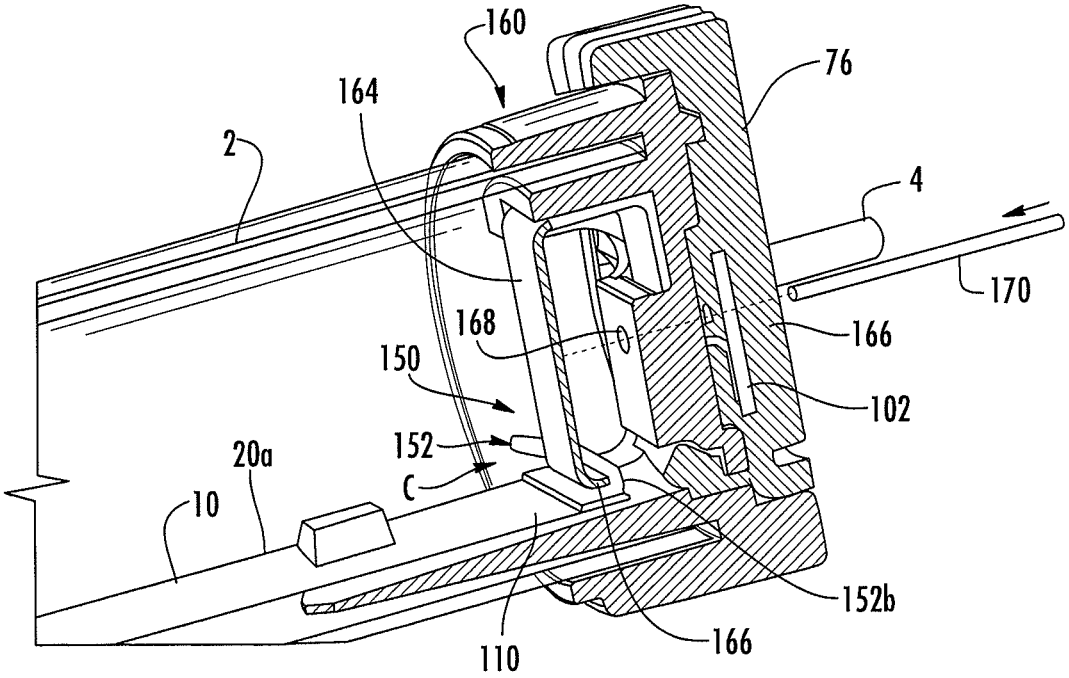
FIG. 21 is a partial section view showing a second embodiment of a LED lamp of the invention.
Figure 22:
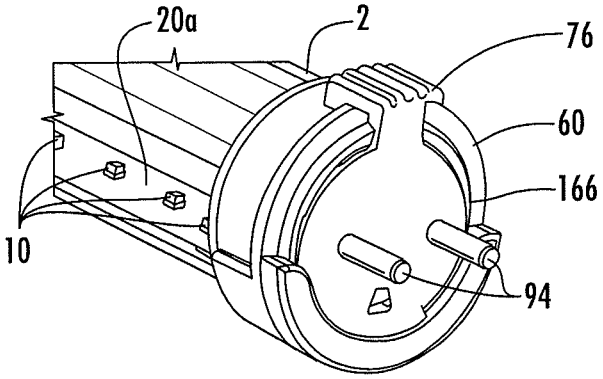
FIG. 22 is a partial perspective view of the lamp of FIG. 23.

An embodiment of an end cap 160 usable in the embodiments of FIGS. 21 through 24 is shown in FIG. 21 and is similar to the end cap of FIGS. 1 through 20 except that the conductors 164 are configured to physically support the substrate 20 as well as provide the electrical connection between the pins 94 and the substrate 20. The conductors 164 comprise resilient, electrically conductive material that is supported in the end cap 60 such that one end of the conductor 164 extends to the outside of the end cap where it forms a pad 102 that may be contacted by pins 94 as previously described. The opposite ends of the conductors 164 extend into interior of the end cap 160. The conductors 164 are supported against the end cap 160 such that the free ends of the conductors 164 extend adjacent to the clip 152 when the end cap 160 is mounted on the tube 2. The conductors 164 are configured such that they may be resiliently deformed to engage the clip 152. The deformed conductors 164 are configured to exert a force (represented by arrow C) on the clip 152 sufficient to place the substrate 20 under tension. It will be appreciated that the conductors on the two end caps exert a pulling force on the substrate 20 to place the substrate under tension. In some embodiments, it has been found that a two pound tension force on the substrate is sufficient to keep the substrate from sagging or vibrating during use. For a 48 inch lamp a 21*b* force applied to a flex circuit maintains the sagging or deflection of a flex circuit to less than 1 mm. For a 48 inch lamp a 31*b* force applied to a flex circuit maintains the sagging or deflection of a flex circuit to approximately 0.5 mm. The conductors 164 may be formed with hooks 166 at the distal ends thereof that engage the clips 152 to exert the tensile force on the substrate 20. The clip 152 is electrically coupled to the copper layer of the flex circuit such that engagement of the conductors 164 with the clips 152 forms part of the electrical path between the pins 94 and the substrate 20. The clips may be formed in two sections 152*a*, 152*b* that connect to two conductors 164 on each end cap to provide both sides of the critical current to the LEDS.

To engage the conductors 164 with the clip 152, a hole 166 may be formed in the control member 76 and a second hole 168, aligned with hole 166, is formed in the end wall 63 of the housing 160. An elongated tool 170 may be inserted into the holes 166, 168 to push the conductors 164 to a deformed position where the substrate 20 may be inserted under the conductors 164 as the end cap 160 is inserted onto the tube 2. When the tool 170 is removed, the conductors 164 return to the undeformed state where the hook 166 is biased into engagement with the clip 152 such that the conductors 164 exerts a tension force on the substrate 20 sufficient to suspend the substrate 20 in the tube 2 with minimum sag or vibration. The substrate 20 is supported between the end caps 60 at either end of the tube 2 such that the substrate 20 is pulled between the end caps 60 and is supported under tension. The substrate 20 is suspended in the tube 2 such that it is spaced from the tube 2 and is supported only at its ends by the engagement of the conductors 164 with the clips 152.

While a clip 152 has been shown that is mounted to the substrate 20, the engagement structure may comprise reinforced electrically conductive eyelets that extend through the substrate 20 or other structures. The conductor 164 may have a distal end configured as other than a hook provided it can engage the engagement structure on the substrate.

In some embodiments the rotation of the ends of the conductors 164 during assembly of the end caps 160 to the tube 2 may interfere with the LEDs 110 mounted at the ends of the substrate 20 adjacent the mounting structure 150. To allow for movement of the conductors 164, the pads located at the ends of the substrate may be provided with paired parallel primary and spare pads as previously described to allow the LEDs to be moved slightly away from the end of the substrate to accommodate movement of the conductors 164.

Figure 32:
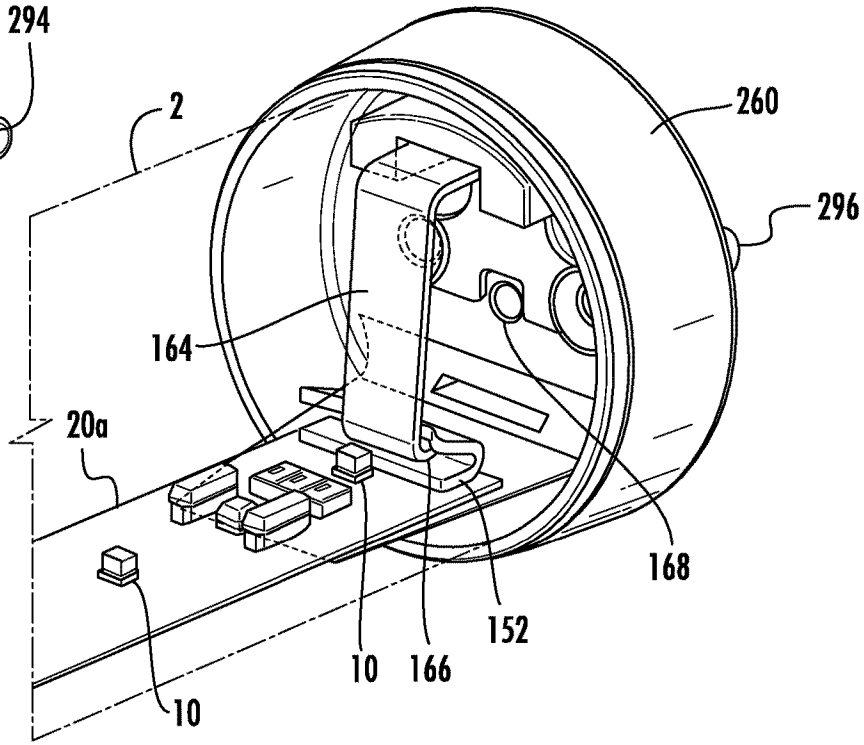
FIG. 32 is another perspective view of the end cap of FIG. 31.
Figure 31:
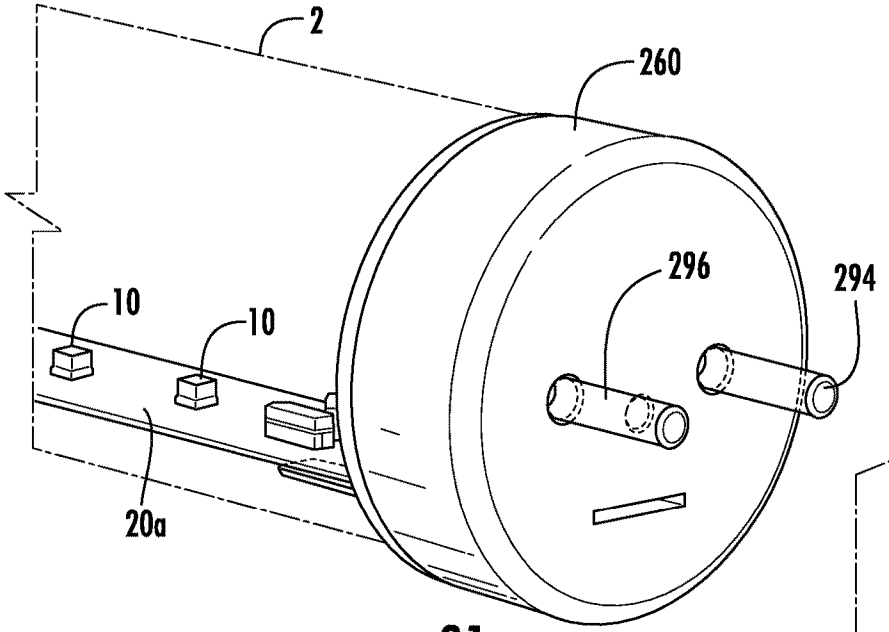
FIG. 31 is a perspective view of an alternate embodiment of an end cap usable in the lamp of the invention.

In some embodiments the pins 94 may be mounted to the end caps in a fixed position such that the pins 94 do not rotate relative to the lamp as shown in FIGS. 31 and 32. The end cap 260 is fixed to the tube 2 such that it does not rotate relative to the tube and the pins 294 and 296 are fixed in the end cap 260. The pin 294 may be electrically and physically coupled to the lamp electronics on the substrate 20*a* as previously described with reference to FIGS. 21-24. In the embodiment of FIGS. 31 and 32 only one pin 294 is electrically active such that only pin 294 is coupled to the substrate 20 by the conductor 164. The second pin 296 is not electrically active and is used to provide physical support of the lamp in the traditional tombstone connector. In such an arrangement the lamp is inserted into the tombstone connectors in the same manner as a traditional fluorescent tube where the pins are located in the tombstone connectors and the entire lamp is rotated to engage the pins with the connectors. One issue with such an arrangement is that the end user may insert the lamp into a fixture with the LEDs facing toward the housing rather than facing outwardly. The use of the rotating control member 76 and pins 94 makes improper installation less likely and simplifies the installation because a user does not have to rotate the entire tube.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an enclosure comprising a tube, the tube being at least partially optically transmissive;

at least one LED in the enclosure operable to emit light through the tube when energized through an electrical path, the at least one LED mounted on a substrate, wherein the substrate comprises a flex circuit comprising a low thermally conductive layer and a metal layer in the electrical path, and wherein the substrate comprises a plurality of subcircuits where the plurality of subcircuits are mechanically and electrically coupled to one another;

a first pair of pins being rotatable relative to the enclosure and being in the electrical path;

an electrical conductor electrically coupling the first pair of pins to the electrical path, the electrical conductor being biased into engagement with an electrical contact on the substrate.

2. The lamp of claim 1 wherein the enclosure comprises a glass tube having a first diffusion layer.

3. The lamp of claim 2 wherein the first diffusion layer comprises an etched inner surface of the tube.

4. The lamp of claim 2 wherein the glass tube comprises a second diffusion layer.

5. The lamp of claim 4 wherein the second diffusion layer comprises a media impregnated with a diffuser applied to an outer surface of the tube.

6. The lamp of claim 1 wherein the enclosure comprises a plurality of LEDs where the plurality of LEDs are mounted on the substrate and extend for substantially the length of the tube.

7. The lamp of claim 1 wherein the substrate is mounted offset from a centerline of the tube.

8. The lamp of claim 1 wherein the substrate is secured to the tube using an adhesive.

9. The lamp of claim 1 wherein the substrate is secured to the end caps and is suspended in the tube.

10. The lamp of claim 1 wherein the plurality of subcircuits are identical to one another.

11. The lamp of claim 1 wherein the plurality of subcircuits comprise a primary pad and a secondary pad connected in parallel to the primary pad.

12. The lamp of claim 11 wherein an LED is mounted on one of the primary pad and the spare pad to vary the distance between the LED and an adjacent LED.

13. The lamp of claim 12 wherein a component is mounted on the flex circuit between the LED and the adjacent LED.

14. The lamp of claim 1 wherein the substrate is trapped between a support surface and the electrical conductor.

15. The lamp of claim 1 wherein the first pair of pins are mounted on an end cap such that the first pair of pins rotate relative to the electrical conductor.

16. The lamp of claim 15 wherein the first pair of pins are mounted in a control member the control member rotatable relative to the end cap.

17. The lamp of claim 16 wherein the control member comprises a spacer that extends into a slot on the end cap.

18. The lamp of claim 17 wherein the substrate is positioned between a support surface and the electrical conductor and the spacer separates the electrical conductor from the support surface when the control member is in a first orientation relative to the end cap.

19. The lamp of claim 18 wherein the spacer is moved to allow the electrical conductor to move into engagement with the substrate when the control member is in a second orientation relative to the end cap.

20. The lamp of claim 19 wherein a lock prevents the control member from moving from the second position to the third position.

21. The lamp of claim 19 wherein the control member is movable from the second position to a third position to rotate the pins relative to the at least one LED.

22. A method of assembling a LED lamp comprising:

providing a tube;

inserting an LED assembly into the tube, the LED assembly comprising an LED mounted on a substrate;

mounting an end cap on the tube, the end cap comprising a support surface for the substrate and a conductor spaced from the supporting surface, wherein mounting the end cap on the tube comprises locating the substrate on the supporting surface between the supporting surface and the conductor;

moving the conductor into engagement with an electrical contact on the substrate after the end cap is mounted on the tube.

23. A lamp comprising:

an enclosure comprising a tube, the tube being at least partially optically transmissive and having a first end and a second end;

at least one LED in the enclosure operable to emit light through the tube when energized through an electrical path;

at least a first pin mounted adjacent the first end of the tube and a second pin mounted adjacent a second end of the tube, the first pin and the second pin being in the electrical path;

the at least one LED mounted on a flex circuit, the flex circuit being in the electrical path and being mounted in the tube without a heat sink wherein the flex circuit is suspended in the tube between the first end and the second end.

24. The lamp of claim 23 wherein a first end cap is connected to the first end and a second end cap is connected to the second end.

25. The lamp of claim 24 wherein the flex circuit is suspended from the first end cap and the second end cap.

26. The lamp of claim 24 wherein the flex circuit is suspended from the first end cap by a first electrical conductor and from the second end cap by a second electrical conductor.

27. The lamp of claim 26 wherein the first electrical conductor and the second electrical conductor are in the electrical path.

28. The lamp of claim 26 wherein the first electrical conductor is electrically coupled to the first pin and the second electrical conductor is electrically coupled to the second pin.

29. The lamp of claim 23 wherein the flex circuit is mounted offset from a centerline of the tube.

30. The lamp of claim 23 wherein the flex circuit comprises longitudinal edges, the longitudinal edges contacting the interior of the tube.

31. A lamp comprising:

an enclosure comprising a tube, the tube being at least partially optically transmissive and having a first end and a second end;

at least one LED in the enclosure operable to emit light through the tube when energized through an electrical path;

at least a first pin mounted adjacent the first end of the tube and a second pin mounted adjacent a second end of the tube, the first pin and the second pin being in the electrical path, a first electrical conductor electrically coupling the first pin to the electrical path and a second electrical conductor electrically coupling the second pin to the electrical path, the first and second electrical conductors being biased into engagement with electrical contacts on the substrate, wherein the first pin is in a first control member, the first control member rotatable relative to a first end cap and the second pin is in a second control member, the second control member rotatable relative to a second end cap such that the first pin and the second pin rotate relative to the electrical conductor wherein the first control member comprises a spacer that extends into a slot on the first end cap;

the at least one LED mounted on a substrate comprising a low thermally conductive layer and a metal layer in the electrical path, the substrate being mounted in the tube without a heat sink.

32. The lamp of claim 31 wherein the substrate is suspended in the tube between the first end and the second end.

33. The lamp of claim 31 wherein the first end cap is connected to the first end and the second end cap is connected to the second end.

34. The lamp of claim 33 wherein the substrate is suspended from the first end cap and the second end cap.

35. The lamp of claim 33 wherein the substrate is suspended from the first end cap by the first electrical conductor and from the second end cap by the second electrical conductor.

36. The lamp of claim 31 wherein the substrate is adhered to the tube.

37. The lamp of claim 31 wherein the substrate is mounted offset from a centerline of the tube.

38. The lamp of claim 31 wherein the substrate comprises longitudinal edges, the longitudinal edges contacting the interior of the tube.

39. A lamp comprising:

an enclosure comprising a tube, the tube being at least partially optically transmissive;

at least one LED in the enclosure operable to emit light through the tube when energized through an electrical path, the at least one LED mounted on a substrate;

an electrical conductor electrically coupled to the substrate;

a first pair of pins being rotatable relative to the enclosure between a first position and a second position, the pins being electrically coupled to the electrical conductor in the first position and the pins being electrically decoupled from the electrical conductor in the second position.

* * * * *